US011420209B2

(12) United States Patent
Berry

(10) Patent No.: US 11,420,209 B2
(45) Date of Patent: Aug. 23, 2022

(54) VARIABLE SPACING RACK

(71) Applicant: BIOCONTROL SYSTEMS, INC., Bellevue, WA (US)

(72) Inventor: Joseph Berry, Bellevue, WA (US)

(73) Assignee: BIOCONTROL SYSTEMS, INC., Bellevue, WA (US)

( * ) Notice: Subject to any disclaimer, the term of this patent is extended or adjusted under 35 U.S.C. 154(b) by 854 days.

(21) Appl. No.: 16/327,263

(22) PCT Filed: Aug. 21, 2017

(86) PCT No.: PCT/US2017/047820

§ 371 (c)(1),
(2) Date: Feb. 21, 2019

(87) PCT Pub. No.: WO2018/039130

PCT Pub. Date: Mar. 1, 2018

(65) Prior Publication Data

US 2019/0217304 A1 Jul. 18, 2019

Related U.S. Application Data

(60) Provisional application No. 62/419,198, filed on Nov. 8, 2016, provisional application No. 62/378,094, filed on Aug. 22, 2016.

(51) Int. Cl.
*B01L 9/06* (2006.01)
*B01L 7/00* (2006.01)

(52) U.S. Cl.
CPC *B01L 9/06* (2013.01); *B01L 7/52* (2013.01); *B01L 2200/022* (2013.01); *B01L 2200/028* (2013.01); *B01L 2300/0829* (2013.01)

(58) Field of Classification Search
None
See application file for complete search history.

(56) References Cited

U.S. PATENT DOCUMENTS

| | | | | |
|---|---|---|---|---|
| 4,830,832 | A | 5/1989 | Arpagaus et al. | |
| 4,938,369 | A | 7/1990 | Carilli | |
| 5,491,492 | A | 2/1996 | Knapp et al. | |
| 2009/0104079 | A1* | 4/2009 | O'Connell | B01L 3/0217 422/400 |
| 2010/0099581 | A1 | 4/2010 | Arciniegas et al. | |
| 2013/0330254 | A1* | 12/2013 | Jensen | B01L 3/50855 422/562 |

(Continued)

FOREIGN PATENT DOCUMENTS

| | | | |
|---|---|---|---|
| CN | 1079296 | A | 12/1993 |
| CN | 2615141 | Y | 5/2004 |

(Continued)

*Primary Examiner* — Matthew D Krcha
(74) *Attorney, Agent, or Firm* — Seed Intellectual Property Law Group LLP

(57) ABSTRACT

A variable spacing PCR amp tube rack can include a plurality of rotors and a plurality of carriages engaged with the rotors so that rotation of the rotors causes translation of the carriages with respect to one another. The rack can include a blade assembly that allows an operator to separate sets of coupled PCR amp tubes from one another. The rack can be designed to accommodate 0.1 ml PCR amp tubes and adjust their spacing from 4.5 mm to 9.0 mm.

30 Claims, 17 Drawing Sheets

(56) References Cited

U.S. PATENT DOCUMENTS

2017/0239663 A1 8/2017 Ceremony et al.

FOREIGN PATENT DOCUMENTS

| | | | |
|---|---|---|---|
| CN | 101784345 | A | 7/2010 |
| CN | 102559488 | A | 7/2012 |
| CN | 103394410 | A | 11/2013 |
| CN | 204013116 | U | 12/2014 |
| CN | 104520003 | A | 4/2015 |
| CN | 204831535 | U | 12/2015 |
| EP | 1414577 | B1 | 10/2009 |
| JP | 2004/340906 | A | 12/2004 |
| JP | 2011/524244 | A | 9/2011 |
| JP | 2013/253992 | A | 12/2013 |
| WO | 2013/175218 | A1 | 11/2013 |
| WO | 2013/184306 | A1 | 12/2013 |
| WO | 2015/110143 | A1 | 7/2015 |

* cited by examiner

VARIABLE SPACING RACK

TECHNICAL FIELD

The present disclosure generally relates to amp tube racks, and more particularly relates to amp tube racks that allow an operator to adjust the spacing between amp tubes held in the racks.

BACKGROUND

Description of the Related Art

Many traditional commercial polymerase chain reaction ("PCR") systems include a 96-well PCR plate having individual wells positioned and spaced apart from one another in a standardized arrangement. While using such systems, technicians often transfer samples from a PCR plate to individual amplification ("amp") tubes, which typically have a 0.2 ml nominal capacity. Many traditional PCR systems also include a 96-well amp tube rack having individual wells positioned and spaced apart from one another in the same standardized arrangement as for the 96-well PCR plate. Many traditional PCR systems also include a multi-channel pipette that allows a technician to simultaneously transfer samples from multiple wells of the PCR plate to multiple amp tubes held by the amp tube rack. The technician's ability to use a multi-channel pipette is facilitated by the fact that the spacing between the wells of the PCR plate is the same as the spacing between the wells of the amp tube rack.

Improvements in the field have led to the development and use of amp tubes having a 0.1 ml nominal capacity, and 384-well amp tube racks with individual wells positioned and spaced apart from one another in a different standardized arrangement than the 96-well amp tube racks. Generally, the spacing between the wells of the 384-well amp tube rack is smaller (e.g., about 4.5 mm center to center) than the spacing between the wells of the 96-well amp tube rack (e.g., about 9.0 mm center to center). Thus, variable spacing multi-channel pipettes have been developed to allow a technician to simultaneously transfer samples from multiple wells at a first spacing to multiple amp tubes at a different spacing. In some cases, variable spacing multi-channel pipettes are less reliable and harder to use than standard, non-variable spacing multi-channel pipettes.

BRIEF SUMMARY

A variable spacing rack may be summarized as comprising: a frame, the frame having a first axis and a second axis, the second axis perpendicular to the first axis; a first carriage, the first carriage elongated and having a length and a first plurality of wells arrayed along the length of the first carriage, the first carriage positioned parallel to the first axis of the frame and mounted to translate along the second axis of the frame; at least a second carriage, the second carriage elongated and having a length and a second plurality of wells arrayed along the length of the second carriage, the second carriage positioned parallel to the first axis of the frame and mounted to translate along the second axis of the frame; a first rotor, the first rotor rotatably mounted to the frame parallel with the second axis of the frame, the first rotor having an outer surface, a first right-handed helical groove in the outer surface of the first rotor, and a first left-handed helical groove in the outer surface of the first rotor; a first pin physically coupled to the first carriage and positioned to ride in the first right-handed helical groove of the first rotor; and at least a second pin physically coupled to the second carriage and positioned to ride in the first left-handed helical groove of the first rotor.

The variable spacing rack may further comprise: a first plurality of additional carriages, in addition to the first and the second carriages, each of the first plurality of additional carriages elongated and having a respective length and a respective plurality of wells arrayed along the length of the respective additional carriage, the first plurality of additional carriages each positioned parallel to the first axis of the frame and mounted to translate along the second axis of the frame; a plurality of additional right-handed helical grooves, in addition to the first right-handed helical groove, in the outer surface of the first rotor; and a first plurality of additional pins, in addition to the first and the second pins, each of the additional pins of the first plurality of additional pins physically coupled to a respective one of the additional carriages of the first plurality of additional carriages and positioned to ride in a respective one of the additional right-handed helical grooves.

The variable spacing rack may further comprise: a second plurality of additional carriages, in addition to the first, the second, and the first plurality of additional carriages, each of the second plurality of additional carriages elongated and having a respective length and a respective plurality of wells arrayed along the length of the respective additional carriage, the second plurality of additional carriages each positioned parallel to the first axis of the frame and mounted to translate along the second axis of the frame; a plurality of additional left-handed helical grooves, in addition to the first left-handed helical groove, in the outer surface of the first rotor; and a second plurality of additional pins, in addition to the first, the second, and the first plurality of additional pins, each of the additional pins of the second plurality of additional pins physically coupled to a respective one of the additional carriages of the second plurality of additional carriages and positioned to ride in a respective one of the additional left-handed helical grooves.

The first carriage and the first plurality of additional carriages may include a total of four carriages and the second carriage and the second plurality of additional carriages may include a total of four carriages. The wells of the first carriage, the second carriage, and the additional carriages of the first and the second pluralities of additional carriages may each be sized and dimensioned to at least partially receive a respective one 0.1 ml amplification tube. The first carriage, the second carriage, and the additional carriages of the first and the second pluralities of additional carriages may each include nine wells. The wells of the first carriage, the second carriage, and the additional carriages of the first and the second pluralities of additional carriages may be spaced apart from one another along the respective lengths of the carriages by about 9.0 mm.

The first right-handed helical groove may have a first pitch and the first left-handed helical groove may have a second pitch, a magnitude of the second pitch equal to a magnitude of the first pitch, a handedness of the first right-handed helical groove opposite to a handedness of the first left-handed helical groove. The variable spacing rack may further comprise: a second rotor, the second rotor rotatably mounted to the frame parallel with the second axis of the frame, the second rotor having an outer surface, a right-handed helical groove in the outer surface of the second rotor, and a left-handed helical groove in the outer surface of the second rotor; a third pin physically coupled to the first carriage and positioned to ride in the first helical groove of the second rotor; and at least a fourth pin physically coupled to the second carriage and positioned to ride in the second helical groove of the second rotor. The first carriage may include a first and a second aperture that each extend completely through the first carriage transversely with respect to the length of the first carriage, and which respectively receive the first and the second rotors therethrough, and the second carriage may include a third and a fourth aperture that each extend completely through the second carriage transversely with respect to the length of the second carriage, and which respectively receive the first and the second rotors therethrough.

A variable spacing rack may be summarized as comprising: a rotor having an outer surface, a first helical groove in the outer surface, and a second helical groove in the outer surface; a first carriage having: a first aperture that extends completely through the first carriage along a first axis; a first pin that extends from the first carriage into the first aperture; and a first well that extends into the first carriage along a second axis that is transverse to the first axis; and a second carriage having: a second aperture that extends completely through the second carriage along the first axis; a second pin that extends from the second carriage into the second aperture; and a second well that extends into the second carriage along a third axis that is parallel to the second axis; wherein the rotor extends through the first aperture and through the second aperture, the first pin is seated within the first helical groove, and the second pin is seated within the second helical groove.

The rotor may have a central longitudinal axis that is coincident with the first axis and rotation of the rotor about the first axis actuates the first and the second carriages to translate along the first axis with respect to the rotor. The first helical groove may have a first helical pitch, the second helical groove may have a second helical pitch that is not the same as the first helical pitch, and rotation of the rotor about the first axis may actuate the first and the second carriages to translate along the first axis with respect to each other. One full rotation of the rotor about the first axis may actuate the first and the second carriages to translate along the first axis by 4.5 mm with respect to each other. The second axis may be perpendicular to the first axis. The first pin may be an end portion of a set screw that extends from the first carriage into the first aperture along an axis parallel to the second axis.

The variable spacing rack may further comprise: a second rotor having a second outer surface, a third helical groove in the second outer surface, and a fourth helical groove in the second outer surface; wherein the first carriage further includes: a third aperture that extends completely through the first carriage along a fourth axis that is parallel to the first axis; and a third pin that extends from the first carriage into the third aperture; wherein the second carriage further includes: a fourth aperture that extends completely through the second carriage along the fourth axis; and a fourth pin that extends from the second carriage into the fourth aperture; and wherein the second rotor extends through the third aperture and through the fourth aperture, the third pin is seated within the third helical groove, and the fourth pin is seated within the fourth helical groove.

The first axis may be parallel to the fourth axis. The first carriage may extend from the first rotor to the second rotor along a fifth axis that is perpendicular to the first, the second, the third, and the fourth axes, and the second carriage may extend from the first rotor to the second rotor along a sixth axis that is parallel to the fifth axis. The variable spacing rack may further comprise: a first PCR amp tube positioned within the first well; and a second PCR amp tube positioned within the second well. The first PCR amp tube may be coupled to the second PCR amp tube, a blade assembly may be mounted to the rack, and the blade assembly may include a blade configured to separate the first PCR amp tube from the second PCR amp tube.

The variable spacing rack may further comprise: a first rail that extends transverse to the first, the second, and the third axes; and a second rail that extends parallel to the first rail; wherein the blade assembly is mounted to the first and second rails to slide along the first and second rails. The variable spacing rack may further comprise a cover positioned above the first and the second wells. The cover includes a first hole positioned above the first well and a second hole positioned above the second well.

A method of operating a variable spacing rack may be summarized as comprising: positioning a set of PCR amp tubes that are coupled to one another into a set of amp tube wells of a plurality of carriages of the variable spacing rack, the plurality of carriages spaced apart from one another by a first distance; translating a blade assembly across the variable spacing rack to separate the PCR amp tubes from one another; turning a rotor engaged with the plurality of carriages, thereby translating the plurality of carriages with respect to one another so that the plurality of carriages are spaced apart from one another by a second distance that is not the same as the first distance; and using a multi-channel pipette to transfer a plurality of samples into the set of PCR amp tubes.

The set of PCR amp tubes may be a set of four 0.1 ml amp tubes, the set of amp tube wells is a set of four amp tube wells, and the plurality of carriages is four carriages. The first distance may be 4.5 mm center to center and the second distance may be 9.0 mm center to center. The rotor may include a plurality of helical grooves and each carriage of the plurality of carriages may include a pin engaged with a respective one of the plurality of helical grooves. The method may further comprise: before using the multi-channel pipette to transfer the plurality of samples into the set of PCR amp tubes, positioning a cover over the PCR amp tubes. The cover may include a plurality of holes and positioning the cover may include positioning the holes directly over the PCR amp tubes.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its broadest sense, that is, as meaning "and/or" unless the context clearly dictates otherwise.

The headings and Abstract of the Disclosure provided herein are for convenience only and do not limit the scope or meaning of the embodiments.

As used in connection with numerical values herein, the term "about" generally means within plus or minus 10%.

Figure 1:
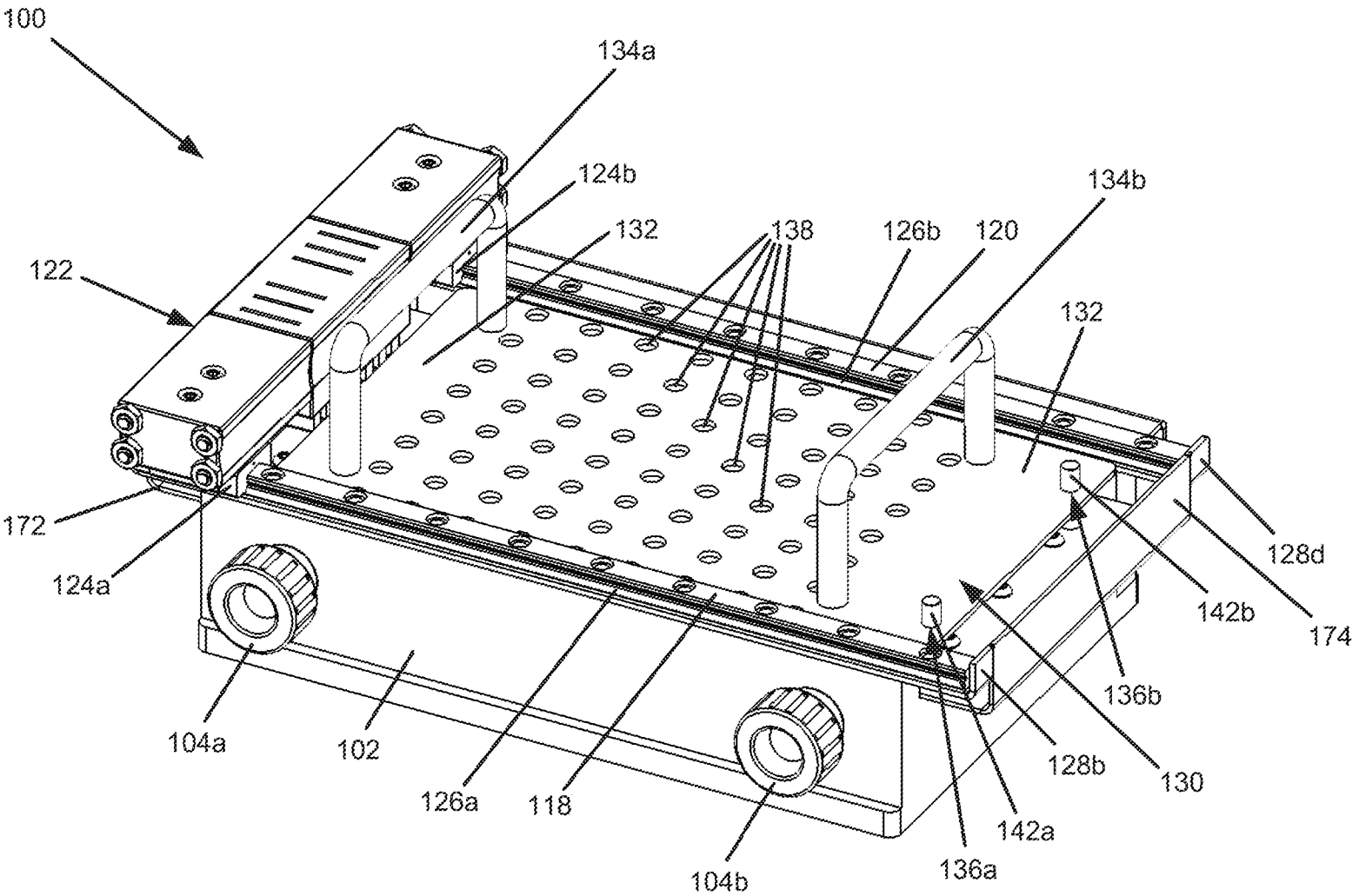
FIG. 1 is a front, top, and right side perspective view of an amp tube rack, according to at least one illustrated embodiment.
Figure 2:
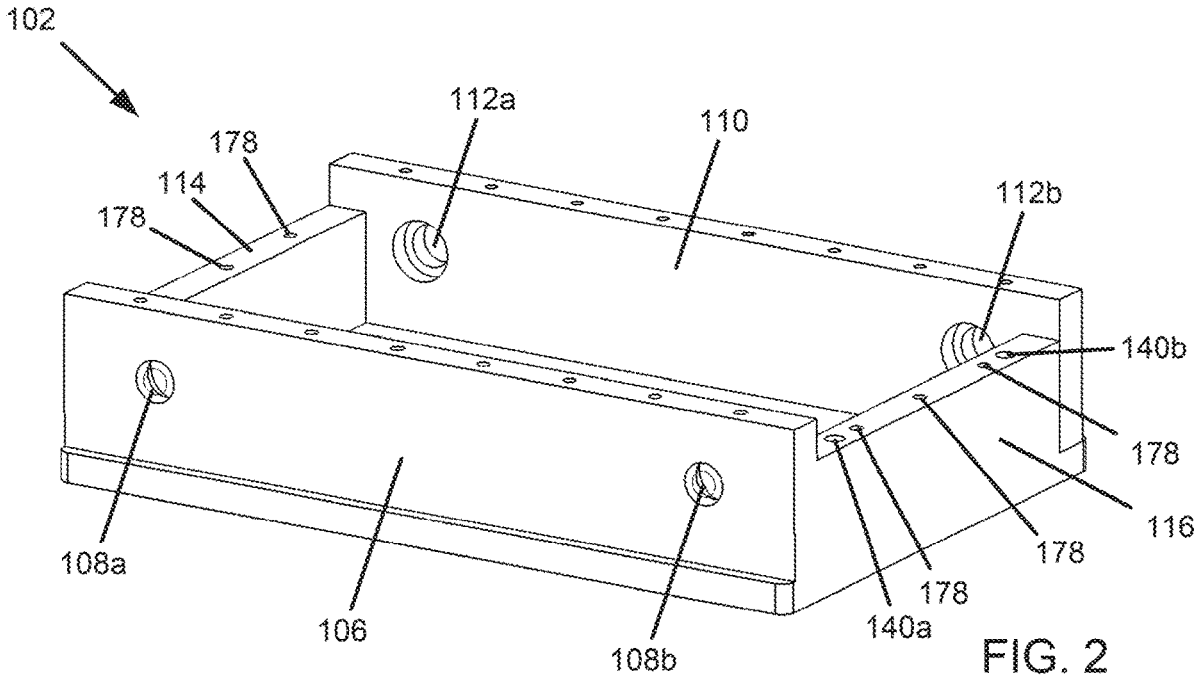
FIG. 2 is a front, top, and right side perspective view of a base frame of the amp tube rack of FIG. 1, according to at least one illustrated embodiment.
Figure 3:
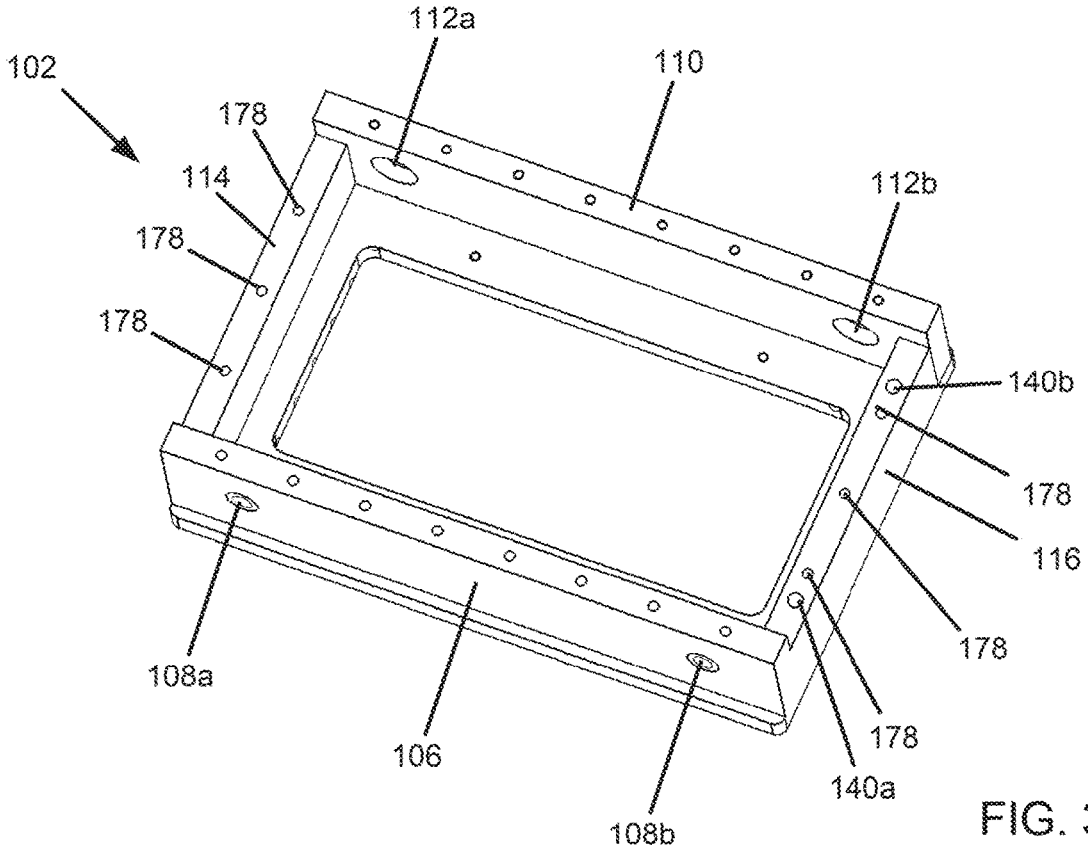
FIG. 3 is another front, top, and right side perspective view of the base frame of FIG. 2, according to at least one illustrated embodiment.

FIG. 1 shows an assembled amp tube rack 100 that allows a user to control or vary the spacing between amp tubes held in the rack. Thus, the rack 100 can also be referred to as a variable spacing rack 100. The rack 100 includes a foundation or base frame 102 that supports the rest of the components of the rack 100. FIGS. 2 and 3 illustrate that the base frame 102 includes a front wall 106 that has two openings 108*a*, 108*b* that extend therethrough to receive bearings such as stainless steel roller bearings. The bearings can be seated or countersunk snugly into the front wall 106 within the openings 108*a*, 108*b*, and can receive portions of respective knobs and/or rotors. The base frame 102 also includes a rear wall 110 that has two openings 112*a*, 112*b* that extend therethrough to receive bearings such as stainless steel roller bearings. The bearings can be seated or countersunk snugly into the rear wall 110 within the openings 112*a*, 112*b*, and can receive portions of respective sprocket gears and/or rotors. The base frame 102 also includes a first, left side wall 114 and a second, right side wall 116.

The base frame 102 has an overall three-dimensional shape generally comprising a rectangular prism, and has a generally rectangular shape from a top plan view. The front and rear walls 106, 110 are generally parallel to one another and extend from side to side along a length of the rack 100. The first and second side walls 114, 116 are generally parallel to one another and generally perpendicular to the front and rear walls 106, 110, and extend from front to back along a width of the rack 100. The rack 100 has a height that is generally perpendicular to its length and to its width. Terms of relative height such as "above," below," "top," "bottom," etc., are used herein to indicate relative locations along the height of the rack 100 with respect to gravity.

As seen in FIG. 1, the rack 100 also includes a pair of knobs 104*a*, 104*b* (collectively, knobs 104) positioned at the front of the rack 100. The knobs 104 engage with respective rotors that extend through the front wall 106 of the base frame 102, and allow an operator to control the spacing between amp tubes held by the rack 100, as described further below. The rack 100 also includes a first, front guide rail 118 coupled to and extending along the length of a first, front runner 126*a*, which is coupled to and extends along the length of the top of the front wall 106. The rack 100 also includes a second, rear guide rail 120 coupled to and extending along the length of a second, rear runner 126*b*, which is coupled to and extends along the length of the top of the rear wall 110. Thus, the front and rear guide rails 118, 120 are coupled to the tops of the front and rear walls 106, 110, respectively, via the front and rear runners 126*a*, 126*b*, respectively.

The rack 100 also includes a blade assembly 122 supported by a pair of guide bearings 124*a*, 124*b* (collectively, guide bearings 124), which can be ball bearings or other types of bearings. The guide bearings 124 are mounted to the guide rails 118 and 120 so they can slide along the guide rails 118 and 120 to carry the blade assembly 122 from side to side across the rack 100. Additional details of the blade assembly 122 are described below.

The front runner 126*a* includes a first, left side upturned portion or vertical tab 128*a* (see FIG. 11), which can act as a backstop to prevent the blade assembly 122 from riding off the ends of the rails 118 and 120 at the left side of the rack 100. The front runner 126*a* also includes a second, right side upturned portion or vertical tab 128*b* (see FIG. 1), which can act as a backstop to prevent the blade assembly 122 from riding off the ends of the rails 118 and 120 at the right side of the rack 100. The rear runner 126*b* includes a third, left side upturned portion or vertical tab 128*c* (see FIG. 11), which can act as a backstop to prevent the blade assembly 122 from riding off the ends of the rails 118 and 120 at the left side of the rack 100. The rear runner 126*b* also includes a fourth, right side upturned portion or vertical tab 128*d* (see FIG. 1), which can act as a backstop to prevent the blade assembly 122 from riding off the ends of the rails 118 and 120 at the right side of the rack 100.

As shown in FIG. 1, the rack 100 also includes a removable top plate, lid, or cover 130. The cover 130 includes a main body or plate portion 132, a first handle 134*a* that extends upwards from a first, left side of the plate portion 132, a second handle 134*b* that extends upwards from a second, right side of the plate portion 132, a first locating aperture 136*a*, a second locating aperture 136*b*, and a plurality of openings or holes 138 arranged in a grid. In the cover 130, the holes 138 are arranged in a grid of eight holes along the width of the rack 100 by nine holes along the length of the rack 100, to match a corresponding grid of amp tube wells positioned below the cover 130, as described further below, and the holes 138 are spaced apart from one another by about 9.0 mm center to center. In alternative implementations, the holes 138 can be arranged in any suitable grid or other arrangement, such as to match variations in the arrangement of amp tube wells positioned below the cover 130.

As shown in FIGS. 2 and 3, the right side wall 116 of the base frame 102 includes a first hole 140*a* extending down into a front portion of the right side wall 116 from its top surface and a second hole 140*b* extending down into a rear portion of the right side wall 116 from its top surface. A distance between the first and second holes 140*a*, 140*b* can match a corresponding distance between the apertures 136*a*, 136*b*, and the holes 140*a*, 140*b* can have the same diameter as the apertures 136*a*, 136*b*. As shown in FIG. 1, a first dowel or pin 142*a* is positioned in the first hole 140*a* and extends upward out of the first hole 140*a* above the top surface of the right side wall 116, and a second dowel or pin 142*b* is positioned in the second hole 140*b* and extends upward out of the second hole 140*b* above the top surface of the right side wall 116.

The plate portion 132 of the cover 130 has a width that corresponds to, but is slightly less than, the distances between the front wall 106 and the rear wall 110, between the runners 126*a* and 126*b*, and between the rails 118 and 120. Thus, the plate portion 132 can be seated over other components of the rack 100, as described further below, between the walls 106, 110, runners 126*a*, 126*b*, and/or the rails 118, 120. Furthermore, a user can set the cover 130 down on the rest of the rack 100 so that the plate portion 132 is so seated and so that the pins 142*a*, 142*b* extend through the apertures 136*a*, 136*b* to engage the plate portion 132 and lock it in position with respect to the rest of the rack 100, such as to mechanically prevent its translation or rotation within a horizontal plane with respect to the rest of the rack 100.

In addition to or in place of the pins 142*a*, 142*b*, and the apertures 136*a*, 136*b*, the plate portion 132 of the cover 130 can include magnetic components such as magnets or ferrous metals, and the base frame 102 of the rack 100 can include complementary magnetic components such as complementary magnets or complementary ferrous metals, at complementary locations. Thus, a user can set the cover 130 down on the rest of the rack 100 so that the plate portion 132 is seated thereon and so that the magnetic components of the plate portion 132 engage with the magnetic components of the base frame 102, to lock the plate portion 132 in position with respect to the rest of the rack 100, such as to magnetically prevent its translation or rotation within a horizontal plane with respect to the rest of the rack 100.

Figure 4:
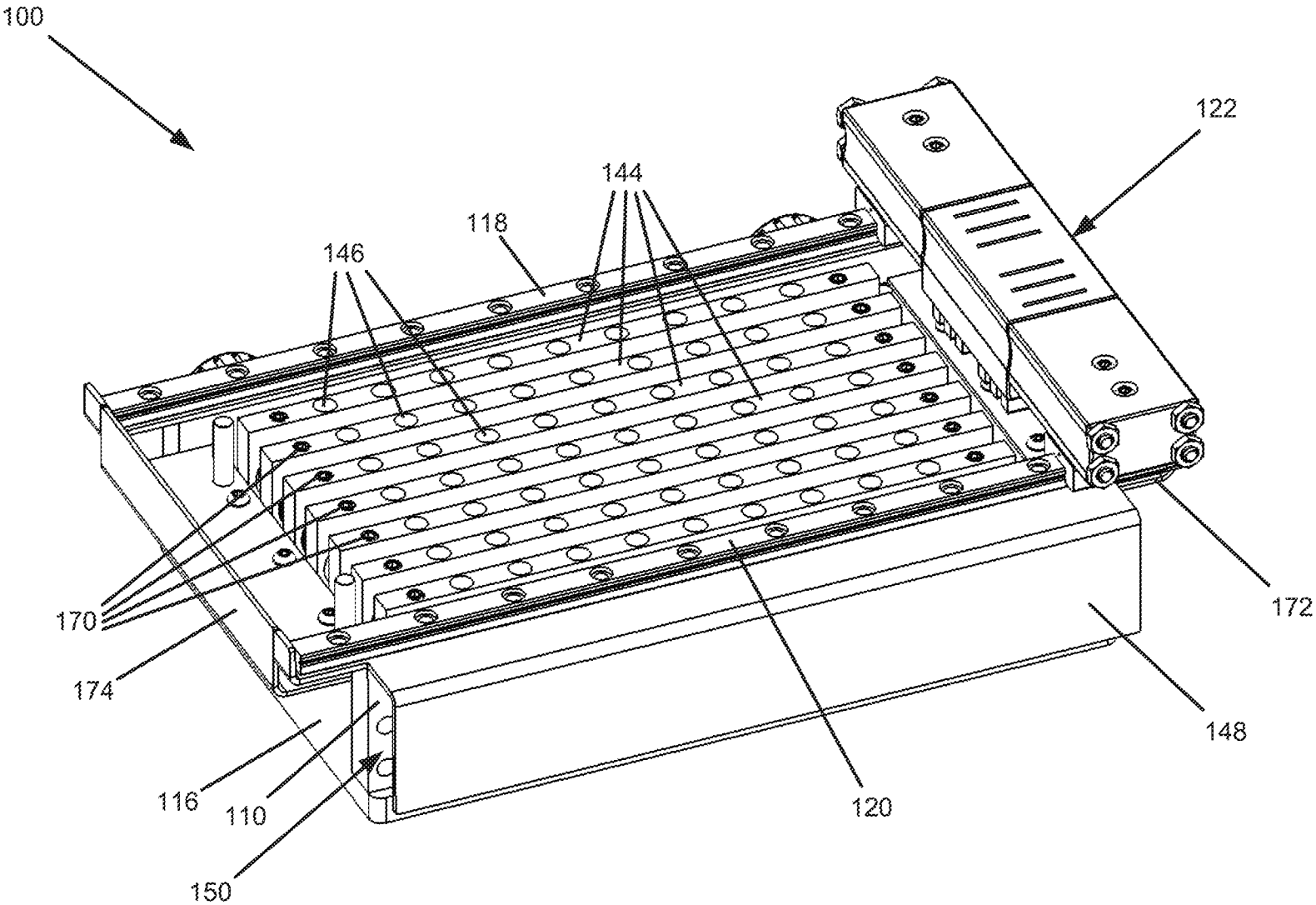
FIG. 4 is a rear, top, and right side perspective view of the amp tube rack of FIG. 1 with the top plate removed to reveal other components of the rack, according to at least one illustrated embodiment.

FIG. 4 illustrates a rear perspective view of the rack 100 with the cover 130 removed. As shown in FIG. 4, the rack 100 includes a plurality of amp tube carriages 144, each of which includes a plurality of amp tube wells 146. As shown further in FIG. 6, the rack 100 includes eight carriages 144 (only four are called out in FIG. 4), each of which includes nine amp tube wells 146, but in alternative implementations, the rack 100 can include more than or less than eight carriages 144 and each of the carriages can include more than or less than nine amp tube wells 146. As also shown in FIG. 4, the rear runner 126*b* includes a back plate or chain guard 148 that extends rearward from the rear wall 110 and the rear rail 120, and then downward, spaced apart from and parallel to the rear wall 110, to create a void or an enclosed space 150 between the rear wall 110 and the chain guard 148.

Figure 5:
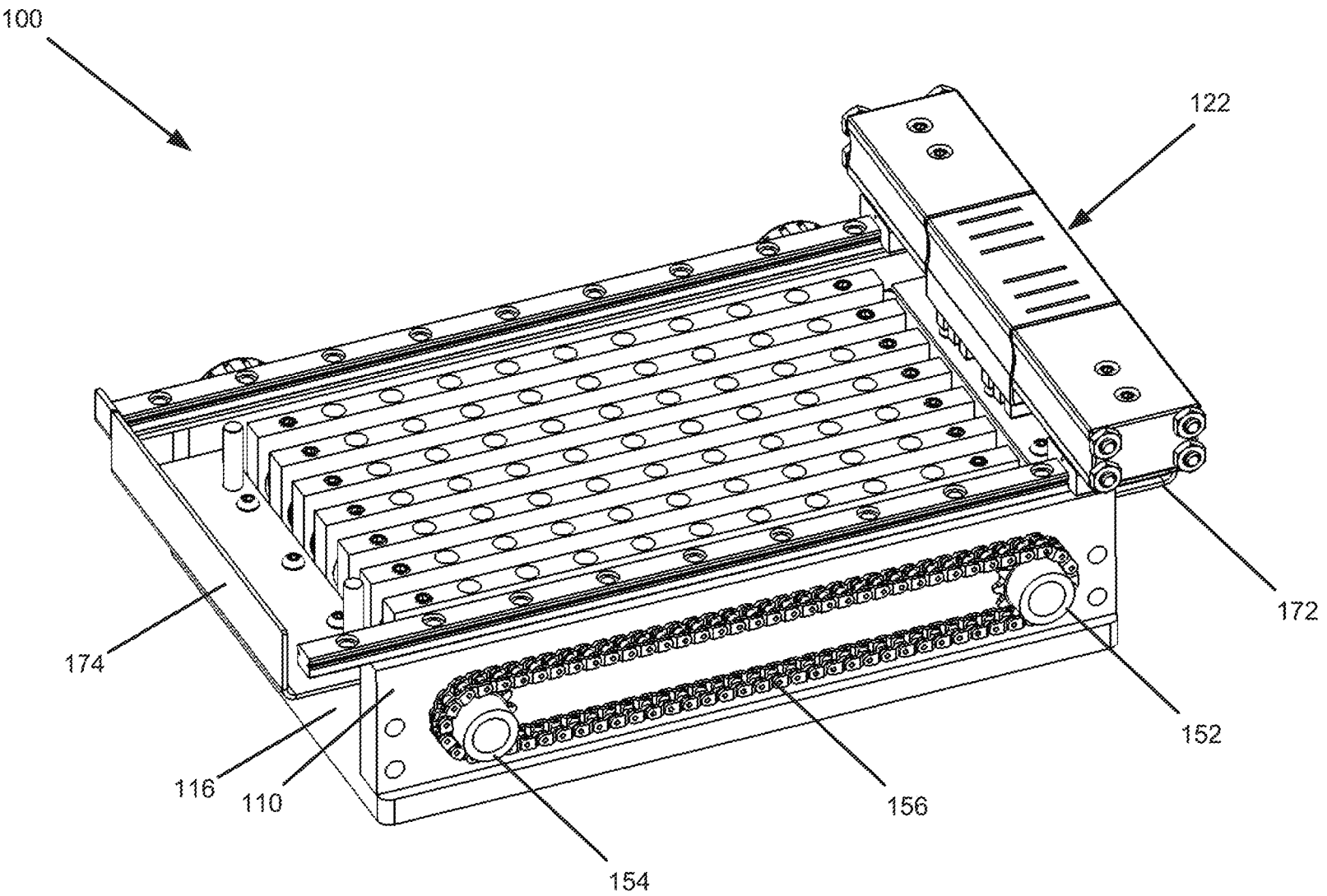
FIG. 5 is a rear, top, and right side perspective view of the amp tube rack of FIG. 1 with a top plate and a rear plate removed to reveal other components of the rack, according to at least one illustrated embodiment.

FIG. 5 illustrates the same view of the rack 100 as FIG. 4, but with the chain guard 148 removed. As shown in FIG. 5, the rack 100 includes a first sprocket gear 152, a second sprocket gear 154, and a drive chain 156 positioned within the enclosed space 150 behind the chain guard 148. The sprocket gears 152 and 154 are identical to one another, engage with respective rotors that extend through the rear wall 110 of the base frame 102, and rotationally lock the two respective rotors to one another to ensure that they rotate in unison. In some implementations, the sprocket gears 152, 154, and drive chain 156 can be made of any one of various suitable plastic materials.

Figure 6:
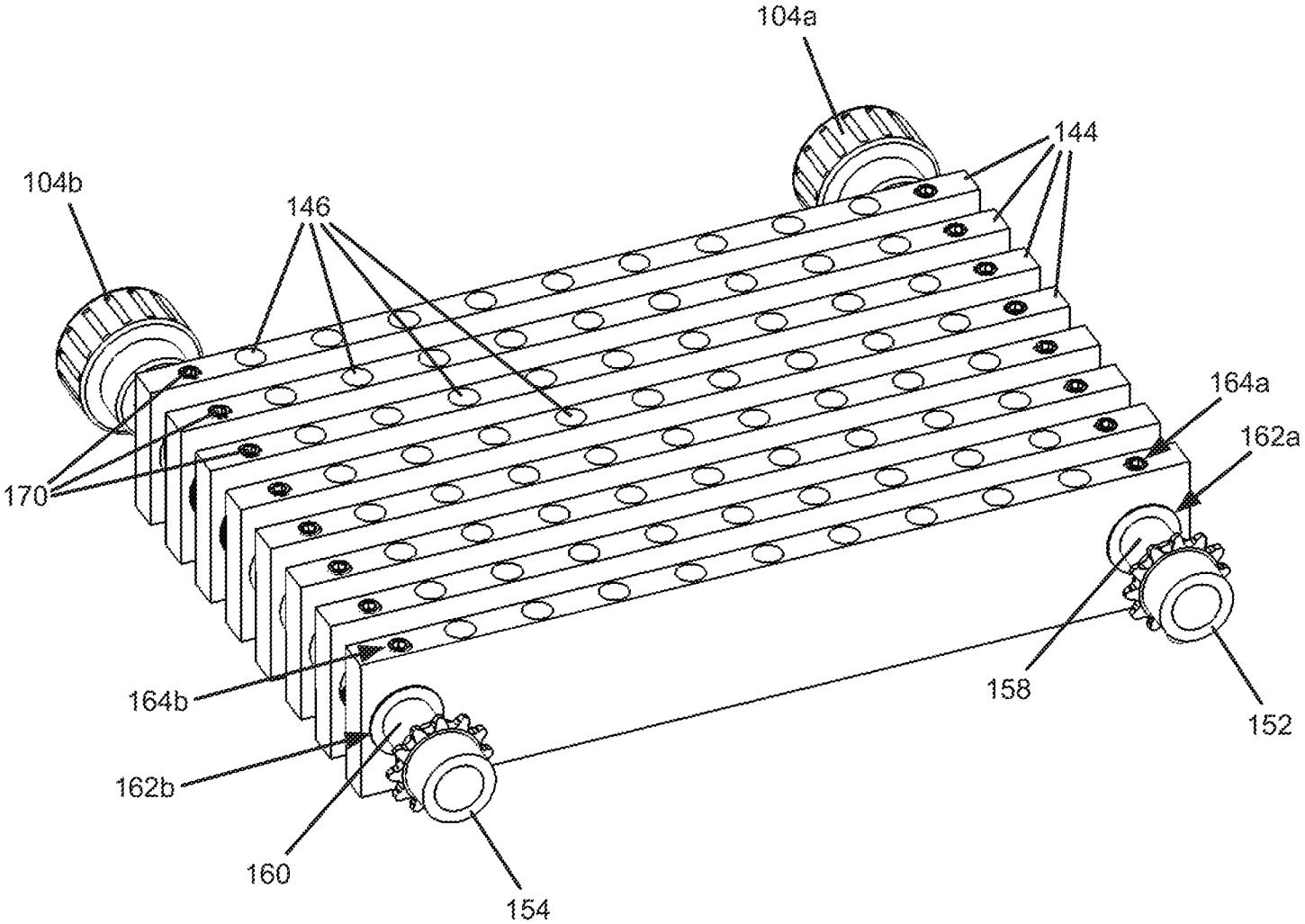
FIG. 6 is a rear, top, and right side perspective view of a plurality of amp tube carriages and a pair of rotors of the amp tube rack of FIG. 1, according to at least one illustrated embodiment.

FIG. 6 illustrates the knobs 104*a* and 104*b*, the sprocket gears 152 and 154, a first rotor 158, a second rotor 160, and the eight carriages 144 isolated from the rest of the rack 100. As shown in FIG. 6, the carriages 144 have the same shape, size, and features as one another, and are mounted on the first and second rotors 158, 160 adjacent to one another. Each of the carriages 144 has an overall shape comprising a rectangular prism, with a longest dimension (i.e., its "length") extending along the length of the rack 100 and along an axis extending from the first rotor 158 to the second rotor 160, a shortest dimension (i.e., its "width") extending along the width of the rack and parallel to the central longitudinal axes of the rotors 158, 160, and an intermediate dimension (i.e., its "height") that extends up and down along a height of the rack 100 and generally perpendicular to the longest and shortest dimensions.

Each of the carriages 144 includes a first aperture 162*a* at a first end thereof along its length, which extends through the width of the carriage 144. Each of the carriages 144 also includes a second aperture 162*b* at a second end thereof opposite to its first end along its length, which extends through the width of the carriage 144. The first and second apertures 162*a*, 162*b* can be sized and otherwise configured to receive the respective rotors 158, 160 therethrough. Each of the carriages 144 also includes a plurality of (e.g., nine) amp tube wells 146 extending partially down into the carriage 144 from its top surface. The amp tube wells 146 can be sized and otherwise configured to receive and hold respective amp tubes, and can be spaced apart from one another along the lengths of the carriages 144 by about 9.0 mm.

Each of the carriages 144 also includes a third aperture 164*a* at the first end thereof along its length, which extends through the height of the carriage 144 from its top surface to the first aperture 162*a*. Each of the carriages 144 also includes a fourth aperture 164*b* at the second end thereof along its length, which extends through the height of the carriage 144 from its top surface to the second aperture 162*b*. Each of the carriages 144 can also include a plurality of set screws, and the third and fourth apertures 164*a*, 164*b* can each be sized, threaded, and otherwise configured to receive the set screws therein, as described further below.

Figure 7:
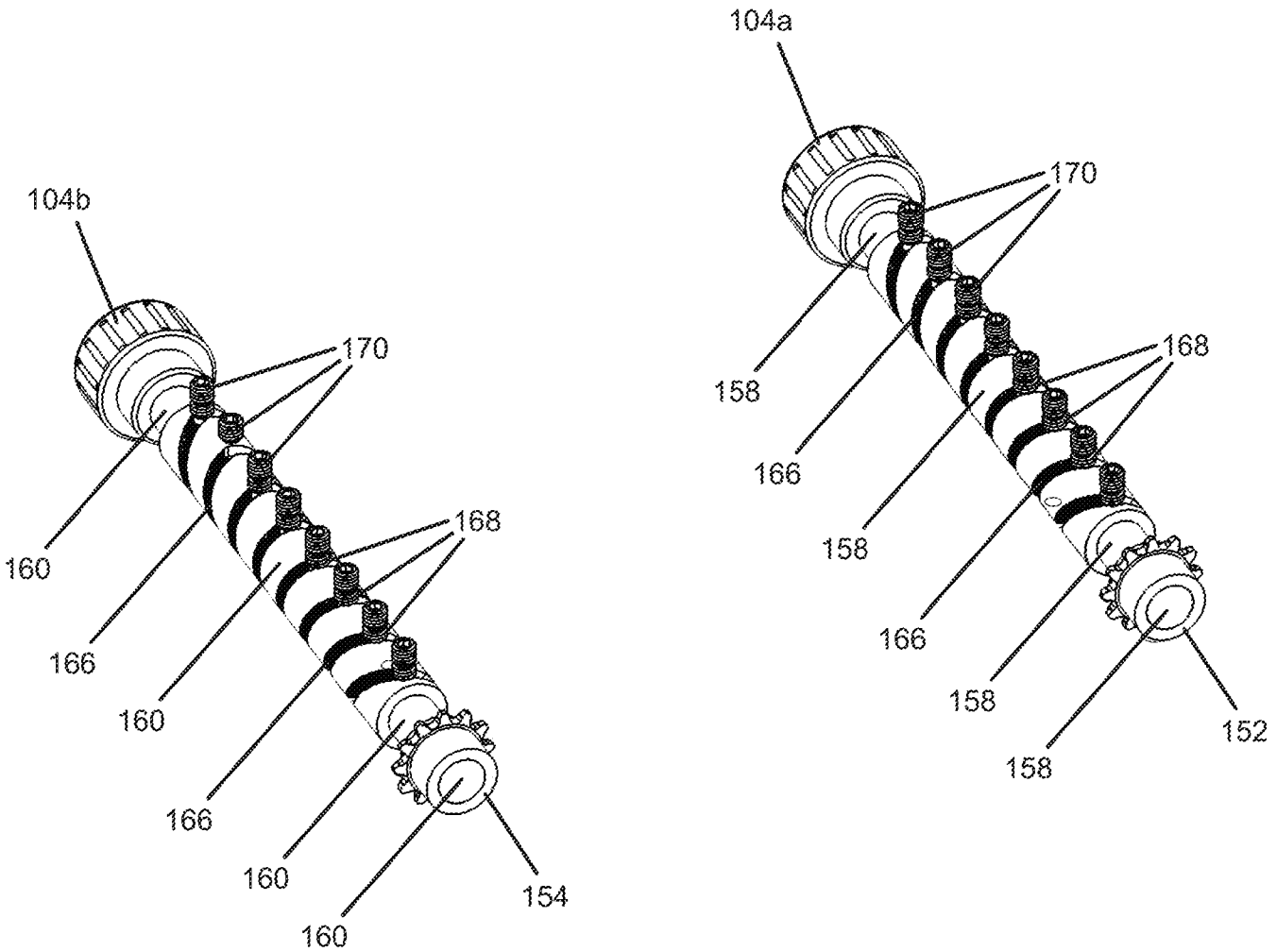
FIG. 7 is a rear, top, and right side perspective view of the pair of rotors of FIG. 6, according to at least one illustrated embodiment.

FIG. 7 illustrates the knobs 104*a* and 104*b*, the sprocket gears 152 and 154, the first and second rotors 158 and 160, and the set screws of the carriages 144 isolated from the rest of the rack 100. As shown in FIG. 7, the knobs 104*a* and 104*b* can be rigidly coupled to the front ends of the rotors 158 and 160, respectively, and the sprocket gears 152 and 154 can be rigidly mounted on the rear end portions of the rotors 158 and 160, respectively, so that rotation of one of the knobs 104*a*, 104*b* turns the respective rotor, which by action of the drive chain 156, also turns the other rotor and the other one of the knobs 104*a*, 104*b*. The front end portions of the rotors 158, 160 adjacent to the knobs 104*a*, 104*b* have a first diameter that corresponds to the diameters of the two openings 108*a*, 108*b* so that the front end portions of the rotors 158, 160 can be mounted snugly within the openings 108*a*, 108*b*.

The rear end portions of the rotors 158, 160, on which the sprocket gears 152 and 154 are mounted, have a second diameter that corresponds to the inside diameters of the bearings seated within the two openings 112*a*, 112*b*, and that is slightly smaller than (e.g., 0.01 inch less than) the inside diameters of the two openings 112*a*, 112*b*, so that the rear end portions of the rotors 158, 160 can be mounted snugly on the bearings and loosely within the openings 112*a*, 112*b*. The second diameter of the rear end portions can be the same as the first diameter of the front end portions of the rotors 158, 160. Main body portions of each of the rotors 158, 160, which extend between the respective front and rear end portions thereof, have a third diameter that is larger than the first and second diameters of the front and rear end portions, and that corresponds to the diameters of the first and second apertures 162*a*, 162*b*, so that the main body portions of the rotors 158, 160 can be mounted snugly within the apertures 162*a*, 162*b*. In some implementations, washers can be mounted on the rotors 158, 160, such as on the front and rear end portions of the rotors 158, 160 adjacent to the main body portions of the rotors 158, 160, such as to fill any gap that arises between the carriages 144 and the front and rear walls 106, 110, as a result of differing machining tolerances. FIG. 7 also illustrates that the main body portions of each of the rotors 158, 160 include a set of eight grooves 166 cut into their outer surfaces.

Figure 8:
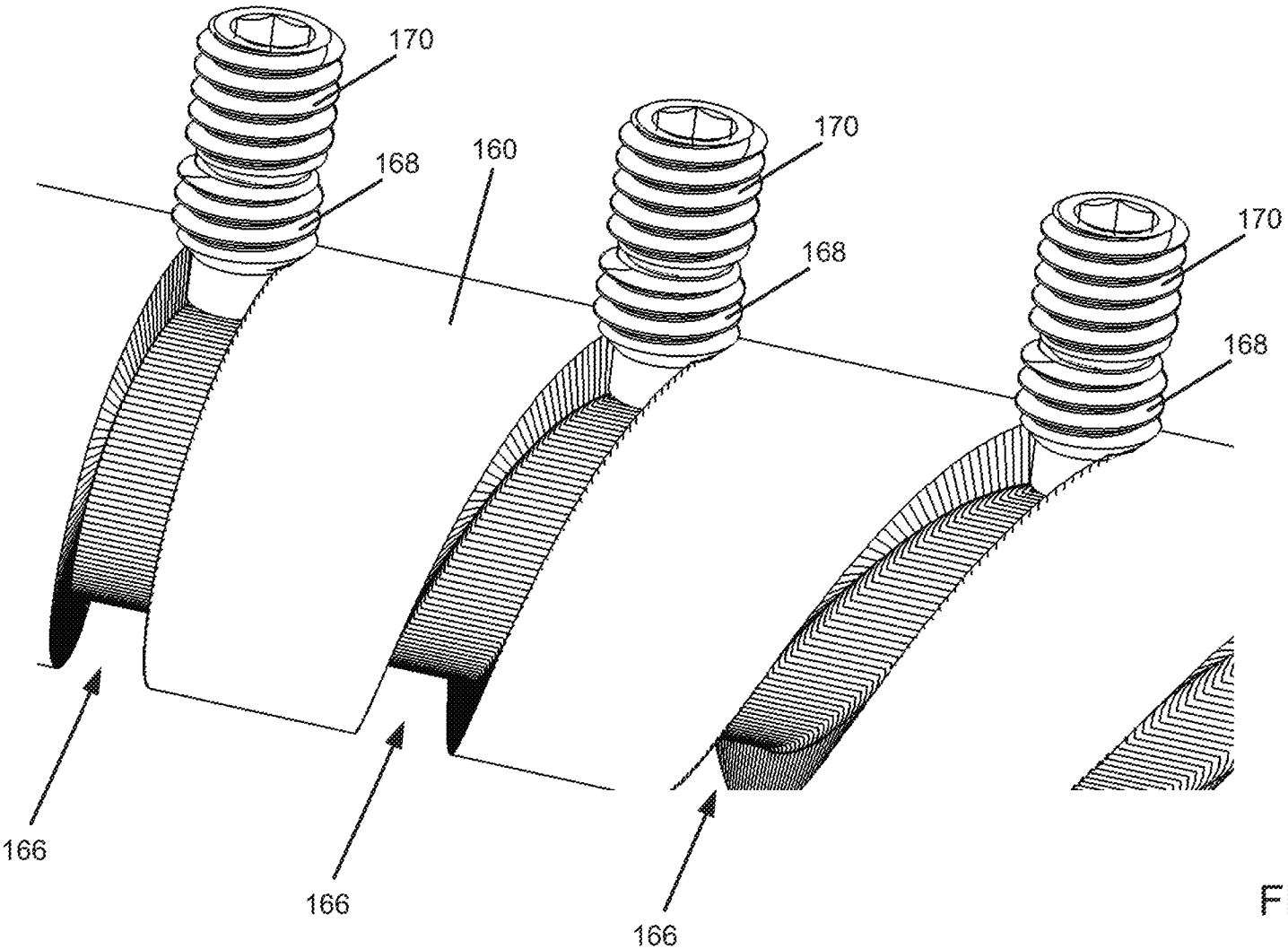
FIG. 8 is a close-up view of one of the rotors of FIG. 7, according to at least one illustrated embodiment.

FIG. 8 illustrates a larger view of a portion of the rotor 160, including some of its grooves 166, and some of the set screws of the carriages 144. As shown in FIG. 8, the carriages 144 can include two set screws positioned within each of the third and fourth apertures 164*a*, 164*b*: a first, lower, dog-point set screw 168, and a second, upper set screw 170. The first and second set screws 168, 170 can include outer threads corresponding to the threads of the third and fourth apertures 164*a*, 164*b*, such that the set screws 168, 170 can be threaded into the third and fourth apertures 164*a*, 164*b*.

The first, dog-point set screws 168 can be threaded and screwed into and downward through the apertures 164*a*, 164*b*, until their dog-point bottom ends form pins that extend out of the apertures 164*a*, 164*b*, into the first and second apertures 162*a*, 162*b*, and into the grooves 166 so that they interact with the main body portions of the rotors 158, 160, while their threaded, upper ends remain within the apertures 164*a*, 164*b*. The second set screws 170 can then be threaded and screwed into and downward through the apertures 164*a*, 164*b*, until their lower ends abut the upper ends of the first, dog-point set screws 168, so that the second set screws 170 lock the dog-point set screws 168 in place.

Figure 9:
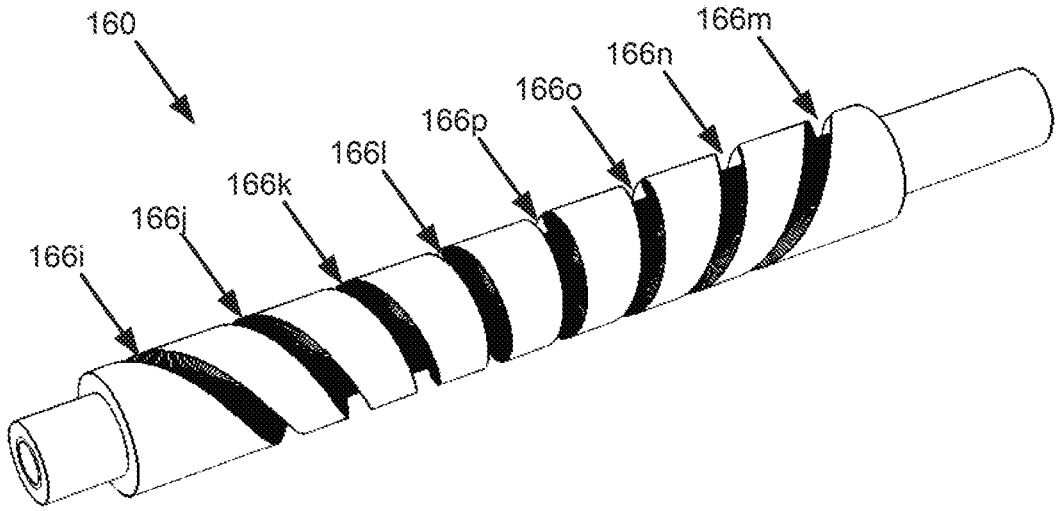
FIG. 9 is a different perspective view of one of the rotors of FIG. 7, according to at least one illustrated embodiment.
Figure 10:
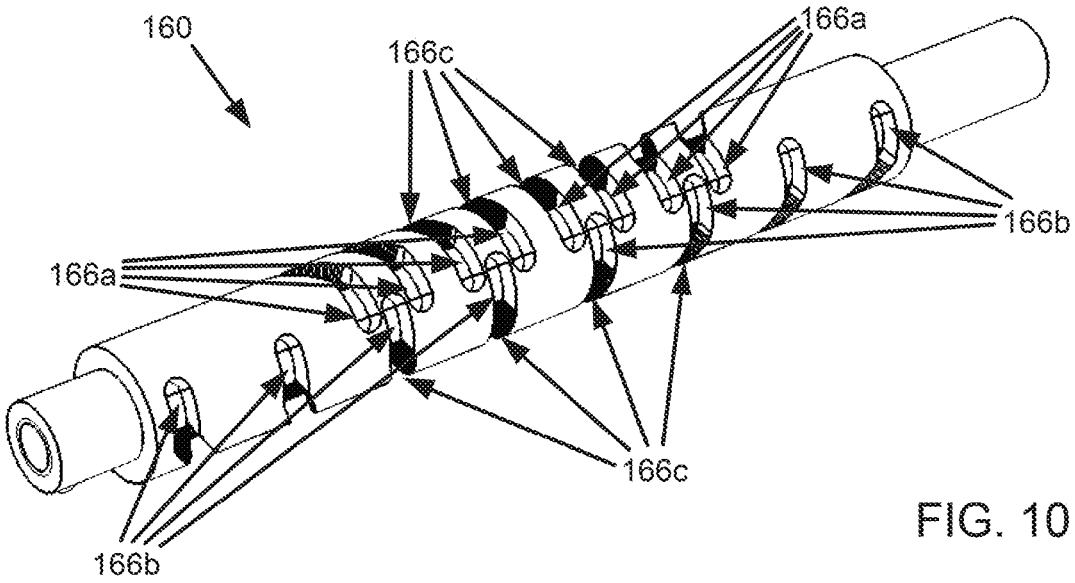
FIG. 10 is another perspective view of the rotor of FIG. 9, according to at least one illustrated embodiment.

FIGS. 9 and 10 illustrate different views of the rotor 160, which can have the same structure as the rotor 158. As shown in FIGS. 9 and 10, each of the grooves 166 includes a non-helical, circumferential inner end portion 166*a*, a non-helical, circumferential outer end portion 166*b*, and a helical portion 166*c* that extends around the rotor 160 from the respective inner end portion 166*a* to the respective outer end portion 166*b*. The inner and outer end portions 166*a*, 166*b* allow an operator to turn the rotor 160 until the dog-points of the first set screws 168 are seated within the non-helical end portions 166*a*, 166*b* to lock the rotor 160 in position rotationally and to lock the carriages 144 in position laterally.

All portions of each of the grooves 166 have vertical sidewalls with respect to the outer cylindrical surface of the main body of the rotor 160, to allow the dog-points of the first set screws 168 to interact effectively with the sidewalls of the grooves 166. Each of the grooves 166 follows a path that extends one full rotation around the circumference of the rotor 160, such that each of the inner end portions 166*a* and the outer end portions 166*b* are aligned with one another along a single axis parallel to the central longitudinal axis of the rotor 160. The helical portions 166*c* of the grooves 166 each have a constant helical pitch, but do not have the same helical pitch and/or do not have the same handedness as one another.

A first one of the grooves 166*i* extends from its outer end portion 166*b* proximate the front end of the rotor 160 to its inner end portion 166*a* proximate a center of the set of grooves 166 longitudinally along the length of the rotor 160. A second one of the grooves 166*j* extends from its outer end portion 166*b* 9.0 mm toward the center of the set of grooves 166 from the outer end portion 166*b* of the first one of the grooves 166*i* (measured center to center) to its inner end portion 166*a* 4.5 mm away from the center of the set of grooves 166 from the inner end portion 166*a* of the first one of the grooves 166*i* (measured center to center). A third one of the grooves 166*k* extends from its outer end portion 166*b* 9.0 mm toward the center of the set of grooves 166 from the outer end portion 166*b* of the second one of the grooves 166*j* (measured center to center) to its inner end portion 166*a* 4.5 mm away from the center of the set of grooves 166 from the inner end portion 166*a* of the second one of the grooves 166*j* (measured center to center). A fourth one of the grooves 166*l* extends from its outer end portion 166*b* 9.0 mm toward the center of the set of grooves 166 from the outer end portion 166*b* of the third one of the grooves 166*k* (measured center to center) to its inner end portion 166*a* 4.5 mm away from the center of the set of grooves 166 from the inner end portion 166*a* of the third one of the grooves 166*k* (measured center to center).

A fifth one of the grooves 166*m* extends from its outer end portion 166*b* proximate the rear end of the rotor 160 to its inner end portion 166*a* proximate the center of the set of grooves 166. A sixth one of the grooves 166*n* extends from its outer end portion 166*b* 9.0 mm toward the center of the set of grooves 166 from the outer end portion 166*b* of the fifth one of the grooves 166*m* (measured center to center) to its inner end portion 166*a* 4.5 mm away from the center of the set of grooves 166 from the inner end portion 166*a* of the fifth one of the grooves 166*m* (measured center to center). A seventh one of the grooves 166*o* extends from its outer end portion 166*b* 9.0 mm toward the center of the set of grooves 166 from the outer end portion 166*b* of the sixth one of the grooves 166*n* (measured center to center) to its inner end portion 166*a* 4.5 mm away from the center of the set of grooves 166 from the inner end portion 166*a* of the sixth one of the grooves 166*n* (measured center to center). An eighth one of the grooves 166*p* extends from its outer end portion 166*b* 9.0 mm toward the center of the set of grooves 166 from the outer end portion 166*b* of the seventh one of the grooves 166*o* (measured center to center) to its inner end portion 166*a* 4.5 mm away from the center of the set of grooves 166 from the inner end portion 166*a* of the seventh one of the grooves 166*o* (measured center to center).

The inner end portion 166*a* of the fourth groove 166*l* is spaced apart from the inner end portion 166*a* of the eighth groove 166*p* longitudinally along the rotor by 4.5 mm (measured center to center), and the outer end portion 166*b* of the fourth groove 166*l* is spaced apart from the outer end portion 166*b* of the eighth groove 166*p* longitudinally along the rotor by 9.0 mm (measured center to center). Thus, the set of grooves 166 are collectively arranged so that they are symmetrical about the center of the set of grooves 166, with grooves 166 on one side of the center of the set of grooves 166 having a first handedness and grooves 166 on the opposite side of the center of the set of grooves 166 having a second handedness opposite to the first handedness. The magnitude of the pitch of any one of the helical portions 166*c* of the grooves 166 is greater than the magnitude of the pitch of any other ones of the helical portions 166*c* closer to the center of the set of grooves 166, and is less than the magnitude of the pitch of any other ones of the helical portions 166*c* farther from the center of the set of grooves 166.

For example, the helical portion of the groove 166*i* has the same pitch but an opposite handedness as the helical portion of the groove 166*m*. As another example, the helical portion of the groove 166*j* has the same pitch but an opposite handedness as the helical portion of the groove 166*n*. As another example, the helical portion of the groove 166*k* has the same pitch but an opposite handedness as the helical portion of the groove 166*o*. As another example, the helical portion of the groove 166*l* has the same pitch but an opposite handedness as the helical portion of the groove 166*p*. Further, the pitch of the helical portions of the grooves 166*i* and 166*m* is greater than the pitch of the helical portions of the grooves 166*j* and 166*n*, which is greater than the pitch of the helical portions of the grooves 166*k* and 166*o*, which is greater than the pitch of the helical portions of the grooves 166*l* and 166*p*.

Figure 11:
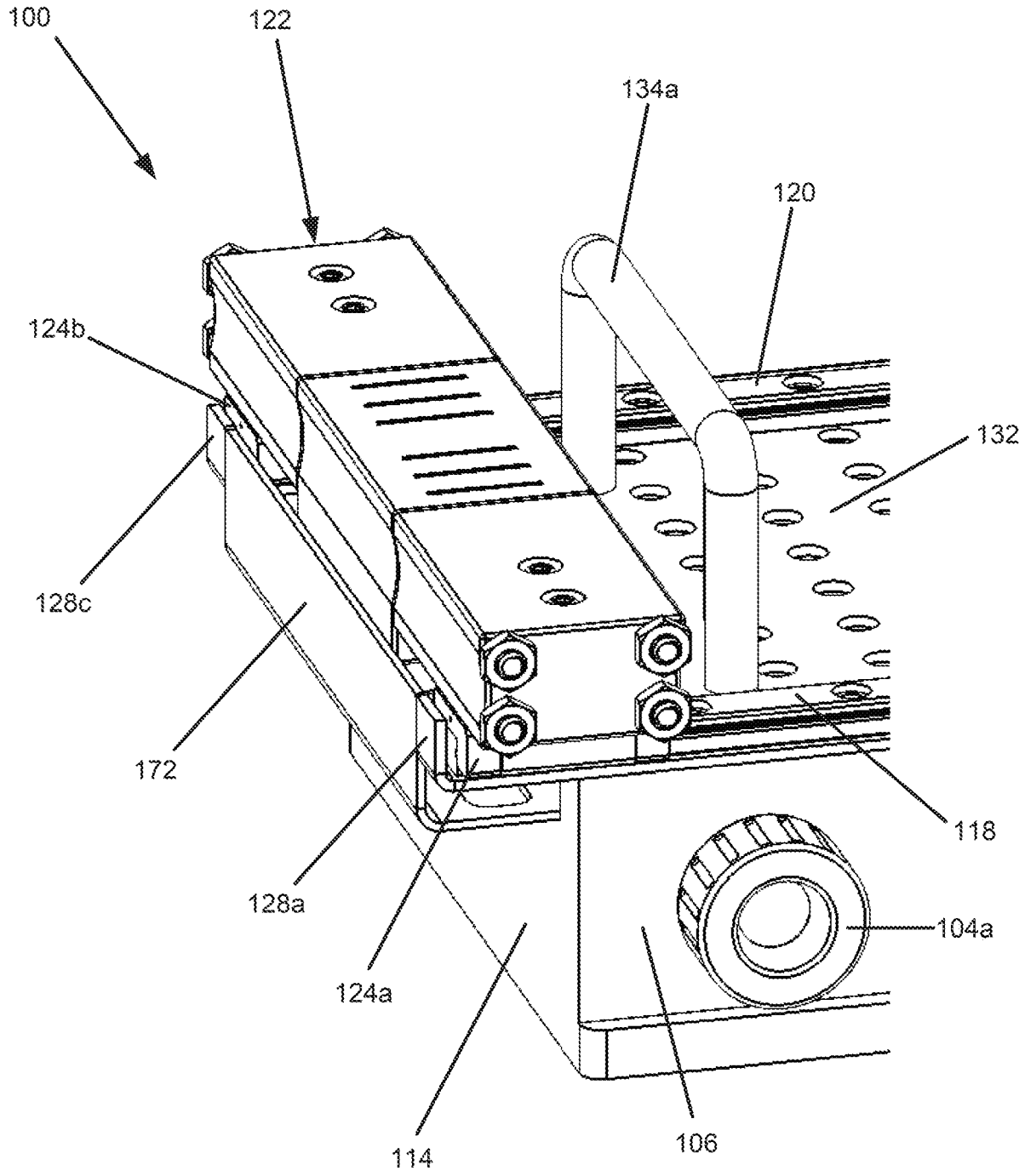
FIG. 11 is a front, top, and left side perspective view of a portion of the amp tube rack of FIG. 1, according to at least one illustrated embodiment.
Figure 12:
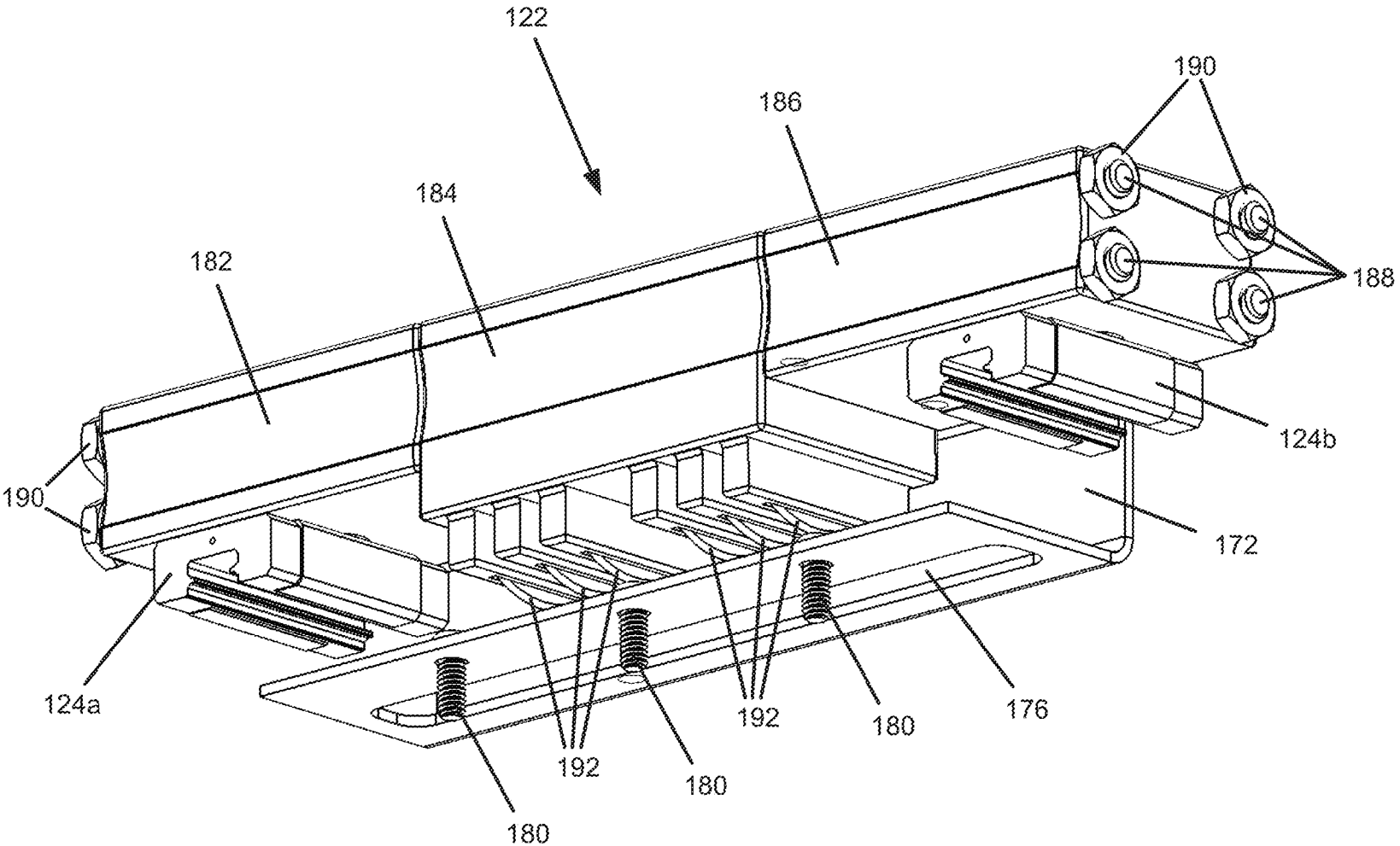
FIG. 12 is a rear, bottom, and right side perspective view of a blade assembly and a blade guard of the amp tube rack of FIG. 1, according to at least one illustrated embodiment.

FIG. 11 illustrates a left side portion of the rack 100 including the blade assembly 122. FIG. 12 illustrates the blade assembly 122 and a first, left side blade guard 172 isolated from the rest of the rack 100, which can be a mirror image of a second, right side blade guard 174 (see FIGS. 1, 4, and 5) except that the blade guard 172 has an access window 176 to allow an operator to access blades of the blade assembly 122, such as for cleaning.

As shown in FIGS. 2 and 3, the left and right side walls 114, 116 of the base frame 102 each include three screw holes 178 extending down into the side walls 114, 116 from their top surfaces. A plurality of screws 180 (FIG. 12) can be screwed through the blade guard 172 and into the screw holes 178 to fasten the blade guard 172 to the top surface of the left side wall 114, and a corresponding plurality of screws can similarly be used to fasten the blade guard 174 to the right side wall 116. The blade guard 172 includes a horizontal portion that extends outward to the left from the left side wall 114 and a vertical portion that extends upward from a lateral end of the horizontal portion. Similarly, the blade guard 174 includes a horizontal portion that extends outward to the right from the right side wall 116 and a vertical portion that extends upward from a lateral end of the horizontal portion.

As shown in FIG. 12, the blade assembly 122 includes a front mounting block 182, a central mounting block 184, and a rear mounting block 186. The mounting blocks 182, 184, and 186 are coupled to one another by a set of four threaded rods 188 that extend through each of the blocks 182, 184, 186, and by respective nuts 190 that hold the blocks 182, 184, 186 on the rods 188. The front guide bearing 124*a* is mounted to the bottom of the front mounting block 182 and the rear guide bearing 124*b* is mounted to the bottom of the rear mounting block 186. A set of six blades 192 is mounted within the central mounting block 184 and have curved edges that extend out of the bottom end of the central mounting block 184 so that they can cut items as the blade assembly 122 is actuated to slide along the rails 118 and 120.

Figure 13:
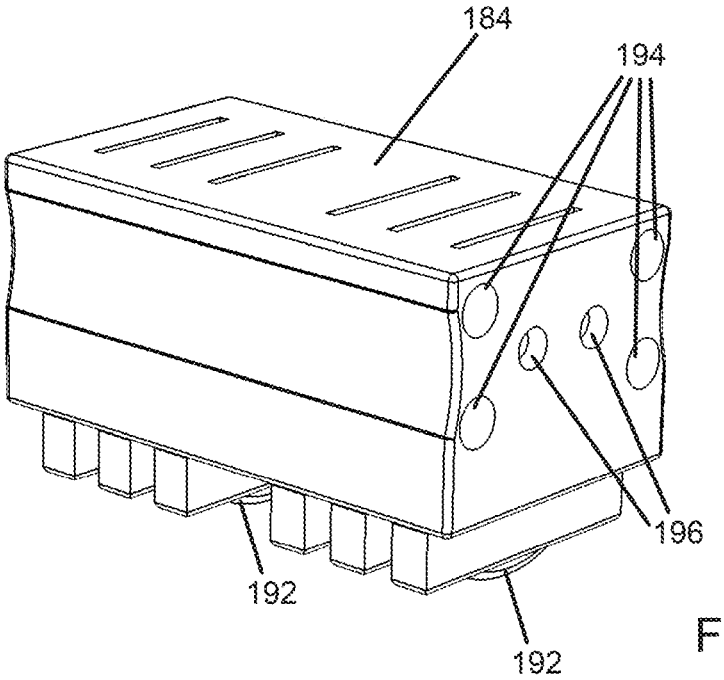
FIG. 13 is a rear, top, and right side perspective view of a central mounting block of the blade assembly of FIG. 12, according to at least one illustrated embodiment.
Figure 14:
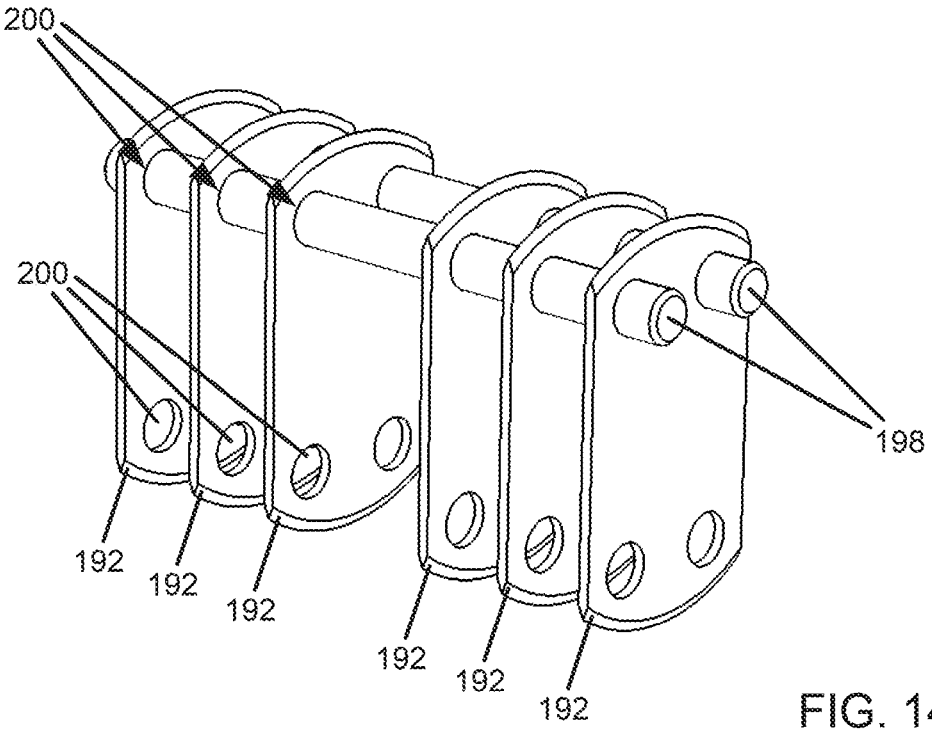
FIG. 14 is a rear, top, and right side perspective view of a set of blades for use in the blade assembly of FIG. 12, according to at least one illustrated embodiment.

FIG. 13 illustrates the central mounting block 184 and the blades 192 isolated from the rest of the rack 100. As shown in FIG. 13, the central mounting block 184 has four peripheral boreholes 194 that extend therethrough from front to back, which are configured to receive the threaded rods 188 therethrough. The central mounting block 184 also has two central boreholes 196 that extend through sidewalls thereof, which are configured to receive and support respective blade-mounting shafts. FIG. 14 shows that the six blades 192 each include four apertures 200, with two near their top and two near their bottom, and that the blades 192 can be mounted on a pair of blade-mounting shafts 198 that extend through the two apertures 200 at the tops of the blades 192. The shafts 198 are configured to be mounted within the central boreholes 196 of the central mounting block 184.

As shown in FIG. 14, the cutting edges of the blades 192 can be curved so that the blades 192 can cut items held by the rack 100 as the blades 192 slide across the rails 118 and 120 from right to left and from left to right, that is, in both directions of travel along the rails 118, 120. As also shown in FIG. 14, the blades 192 have apertures 200 at both their top ends and their bottom ends, so that once a cutting edge of one or more of the blades 192 have dulled from use, the blades 192 can be mounted upside-down for further use. The blades 192 can be replaced either by disassembling the blade assembly 122, replacing the blades 192, and re-assembling the blade assembly 122, or by simply replacing the entire blade assembly 122, with or without the guide bearings 124*a*, 124*b*.

Figure 15:
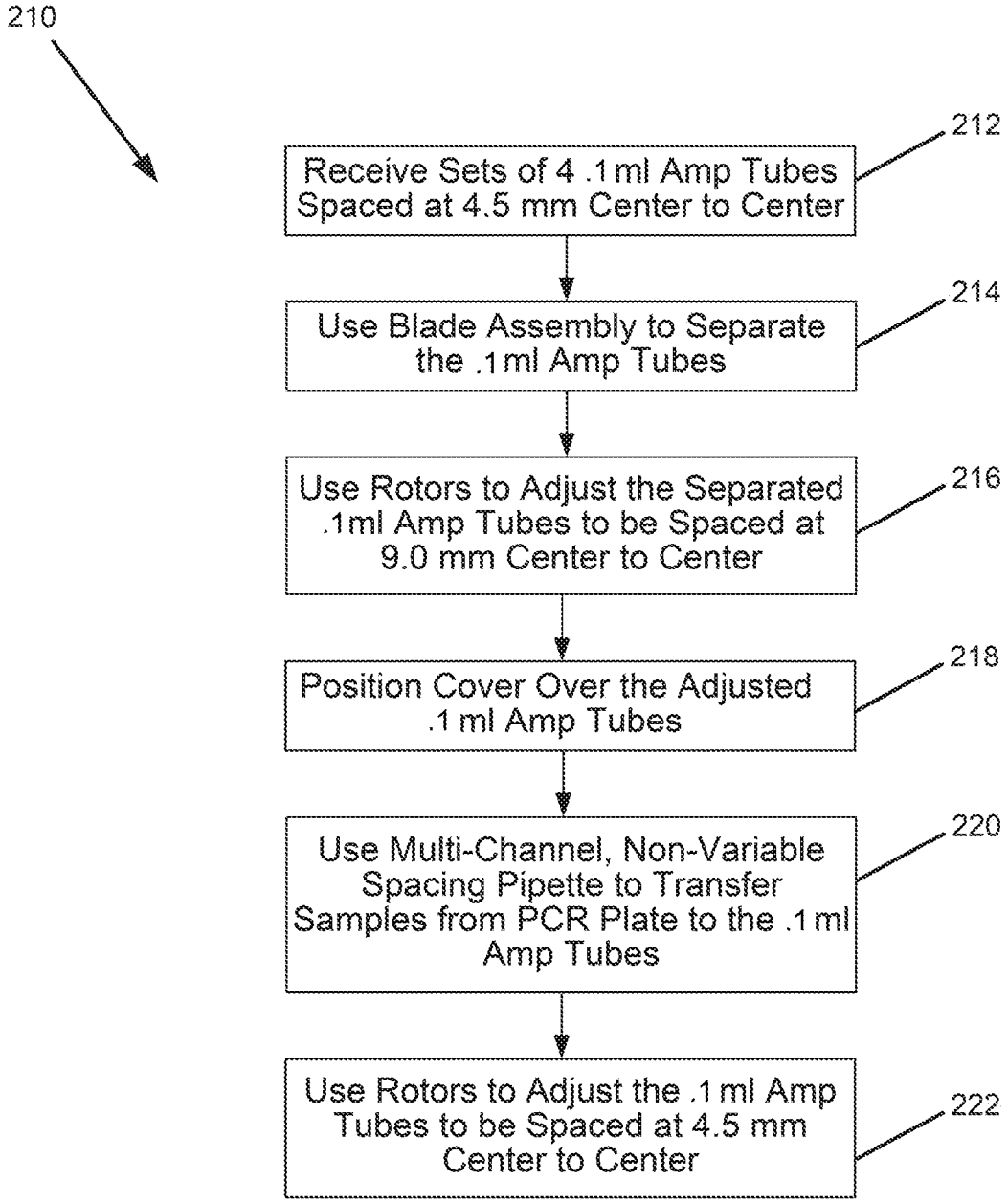
FIG. 15 is a flow chart diagram illustrating a method of using the blade assembly of FIG. 1, according to at least one illustrated embodiment.
Figure 16:
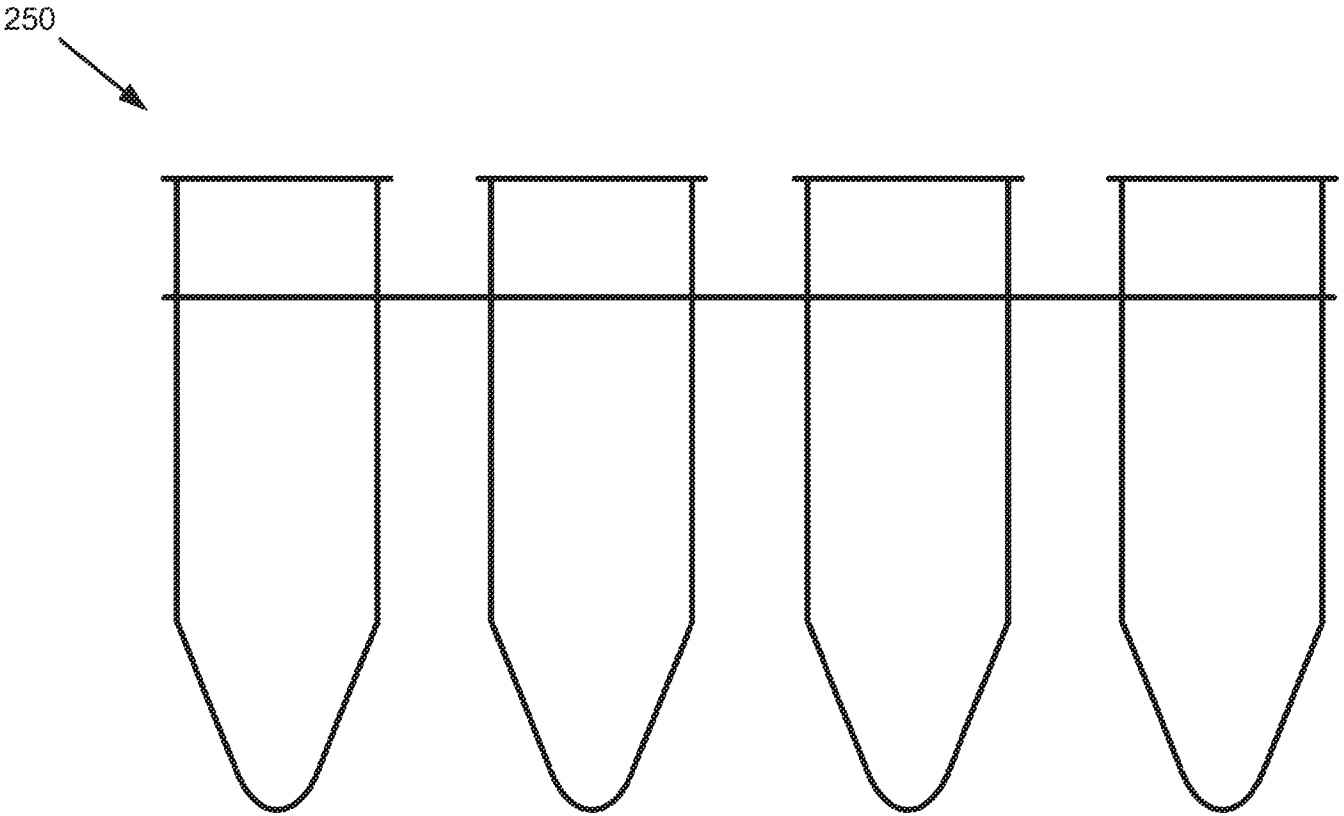
FIG. 16 is a side view of a set of four amp tubes coupled to one another, according to at least one illustrated embodiment.

FIG. 15 is a flow chart diagram showing a method 210 of using the rack 100, according to at least one illustrated embodiment. In method 210, an operator can receive 0.1 ml amp tubes coupled to one another in sets of four amp tubes 250 arranged in a row (see FIG. 16), with the individual amp tubes spaced at 4.5 mm center to center, at reference numeral 212. The operator can remove the cover 130 from the rest of the rack 100 to reveal the amp tube wells 146. The operator can turn the knobs 104*a* and/or 104*b* to rotate the rotors 158 and 160, so that the sidewalls of the grooves 166 interact with the dog-points of the first set screws 168 to adjust the locations of the carriages 144 so that the amp tube wells 146 are spaced apart from one another by 4.5 mm center to center.

The operator can then position the sets of amp tubes in the amp tube wells 146 so that adjacent amp tubes of the four coupled amp tubes are positioned in amp tube wells 146 of adjacent carriages 144. Because the amp tubes are received in sets of four and because there are eight carriages 144, two sets of four coupled amp tubes can be positioned adjacent one another to form a line of eight amp tubes extending across the width of the rack 100. Because the carriages 144 each include nine amp tube wells 146, the operator can position up to eighteen sets of four coupled amp tubes in the rack 100 at one time, so that the amp tubes are arranged in nine rows of eight amp tubes extending across the width of the rack 100.

The operator can then manually push the blade assembly 122 from side to side along the length of the rack 100, so that the six blades 192 sever the bonds coupling the adjacent amp tubes to one another, at reference numeral 214. The operator can turn the knobs 104*a* and/or 104*b* to rotate the rotors 158 and 160, so that the sidewalls of the grooves 166 interact with the dog-points of the first set screws 168 to adjust the locations of the carriages 144 so that the amp tube wells 146 are spaced apart from one another by 9.0 mm center to center, at reference numeral 216.

The operator can then position the cover 130 on the rest of the rack 100 such that the cover 130 is positioned with the pins 142*a*, 142*b* extending through the apertures 136*a*, 136*b*, so that the cover 130 partially conceals the amp tubes and so that the holes 138 are positioned directly above the amp tubes, at reference numeral 218. The operator can then use a multi-channel (e.g., eight-channel) non-variable spacing pipette to transfer samples from wells of a PCR plate (e.g., a 96-well PCR plate with wells spaced at 9.0 mm center to center) into the amp tubes held in the rack 100 (which are spaced at 9.0 mm center to center), at reference numeral 220.

The multi-channel pipette can be manually-operated or automated, with one suitable example of an automated pipette being sold under the brand name PIPETMAX. When the pipette is used to deposit samples into the 0.1 ml amp tubes, the tips of the pipette can break, puncture, or rupture foil or other seals at the tops of the amp tubes as the tips of the pipette are lowered into the top ends of the amp tubes to deposit the samples. In some cases, it has been found that the tips of the pipette can bind on the ruptured foil seal as they are withdrawn from the amp tubes after the samples have been deposited. The holes 138 have diameters that are slightly smaller than the outside diameters of the amp tubes so that if the tips of the pipette bind on the ruptured foil, then the cover 130 holds the amp tubes in place in the amp tube wells 146 as the tips of the pipette are withdrawn from the amp tubes.

Once the samples have been deposited into the amp tubes held by the rack 100, the cover 130 can be removed from the rest of the rack 100 and the operator can turn the knobs 104*a* and/or 104*b* to rotate the rotors 158 and 160, so that the sidewalls of the grooves 166 interact with the dog-points of the first set screws 168 to adjust the locations of the carriages 144 so that the amp tube wells 146 are spaced apart from one another by 4.5 mm center to center, at reference numeral 222. The operator can receive amp tube caps coupled to one another in sets of four amp tube caps arranged in a row, with the individual amp tube caps spaced at 4.5 mm center to center. The operator can then couple the sets of amp tube caps to the top ends of the amp tubes, thereby sealing the amp tubes and coupling the amp tubes back to one another in sets of four amp tubes arranged in a row, with the individual amp tubes spaced at 4.5 mm center to center. The operator can then remove the sets of amp tubes from the rack 100 and move them to other pieces of equipment for further processing or analysis. For example, the operator can move the sets of amp tubes to a 72-well rotor for testing.

Figure 17:
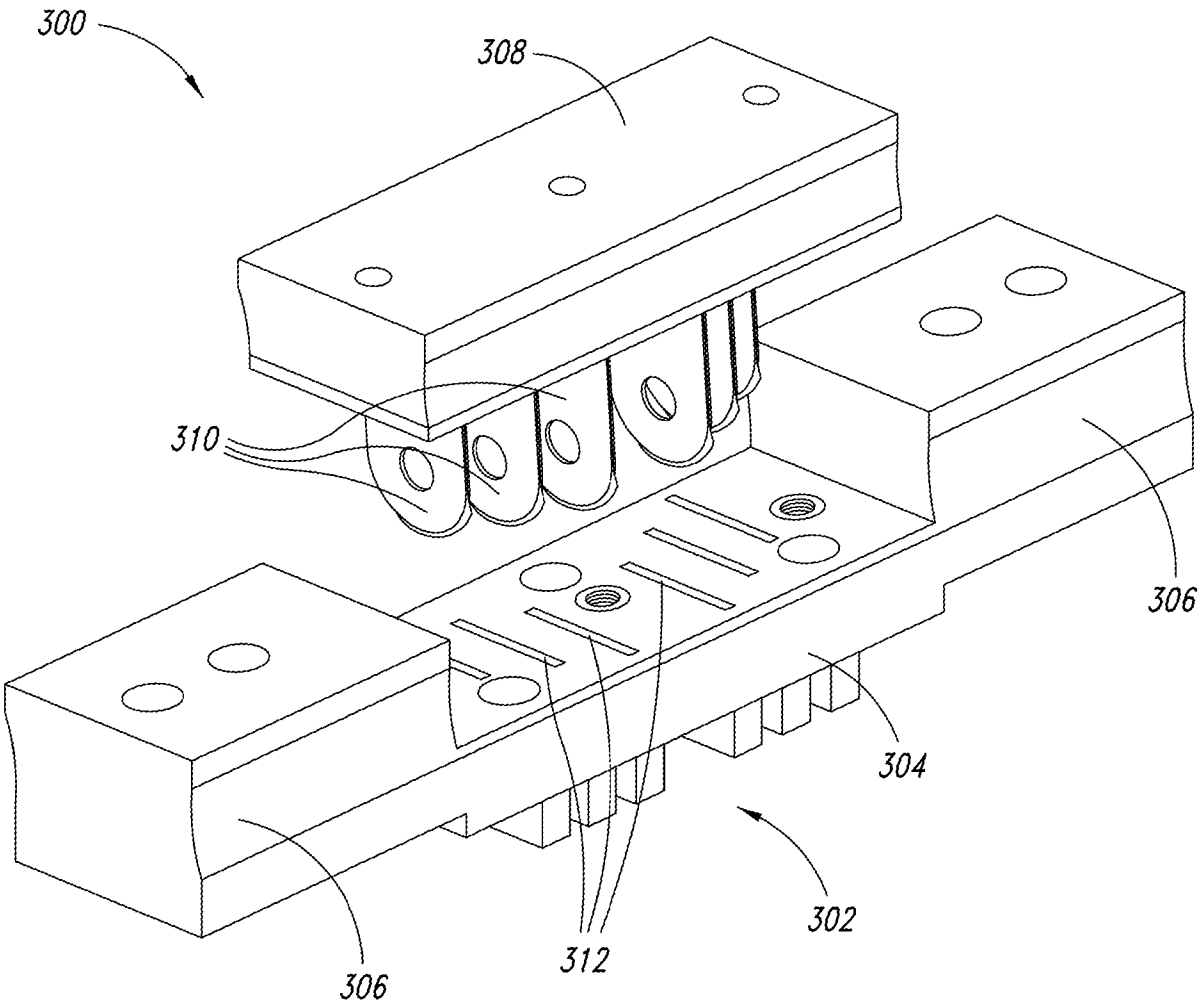
FIG. 17 is a perspective view of a blade assembly, according to at least one illustrated embodiment.

As seen in FIGS. 12-14, the blade assembly 122 includes mounting blocks 182, 184, and 186 coupled to one another by a set of four threaded rods 188. FIG. 17 illustrates a perspective view of one alternative implementation of a blade assembly 300, which can include a bottom frame portion 302 having a relatively short or shallow intermediate portion 304 coupled to and positioned between two relatively tall end portions 306. The blade assembly 300 also includes an upper, central mounting block 308, which can be positioned on top of the intermediate portion 304 and snugly between the two tall end portions 306. When the central mounting block 308 is so positioned, its top surface can be flush with top surfaces of the two tall end portions 306. FIG. 17 also illustrates that the blade assembly 300 can include a set of six blades 310 that can be positioned to extend through respective slots 312 extending through the intermediate portion 304 of the bottom frame portion 302. The central mounting block 308 can be removed from the rest of the blade assembly 300 to allow an operator to access, clean, and/or replace the blades 310, and can be positioned on the rest of the blade assembly 300 to secure the blades 310 in position for use.

Figure 18:
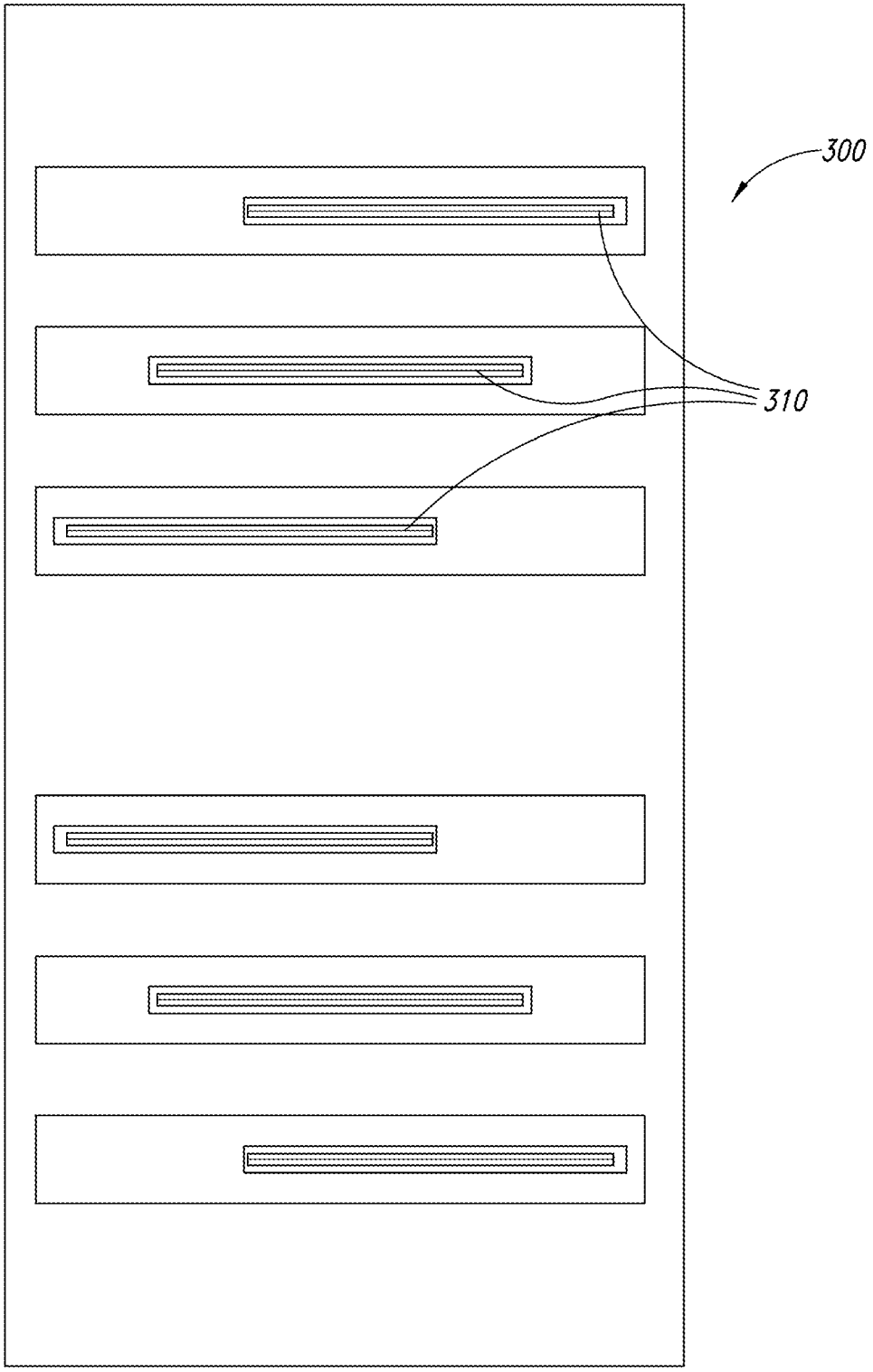
FIG. 18 is a partial bottom view of the blade assembly of FIG. 17, according to at least one illustrated embodiment.

As also seen in FIGS. 12-14, the six blades 192 are arranged in a straight line across a length of the central mounting block 184 in a direction aligned with the width of the rack 100. FIG. 18 illustrates a partial bottom view of the alternative implementation of the blade assembly 300, which can include the set of six blades 310 arranged in a "V" formation, with blades 310 nearer the center of the mounting block 300 along its length positioned nearer to a first side of the mounting block 300 along a width of the mounting block 300, and with blades 310 farther from the center of the mounting block 300 along its length positioned nearer to a second side of the mounting block 300 opposite its first side along the width of the mounting block 300. Arranging the blades 310 in such a "V" formation can facilitate their severing of the bonds coupling adjacent amp tubes to one another and can thereby improve the smoothness of the separation of the amp tubes by the blades 302.

Figure 19:
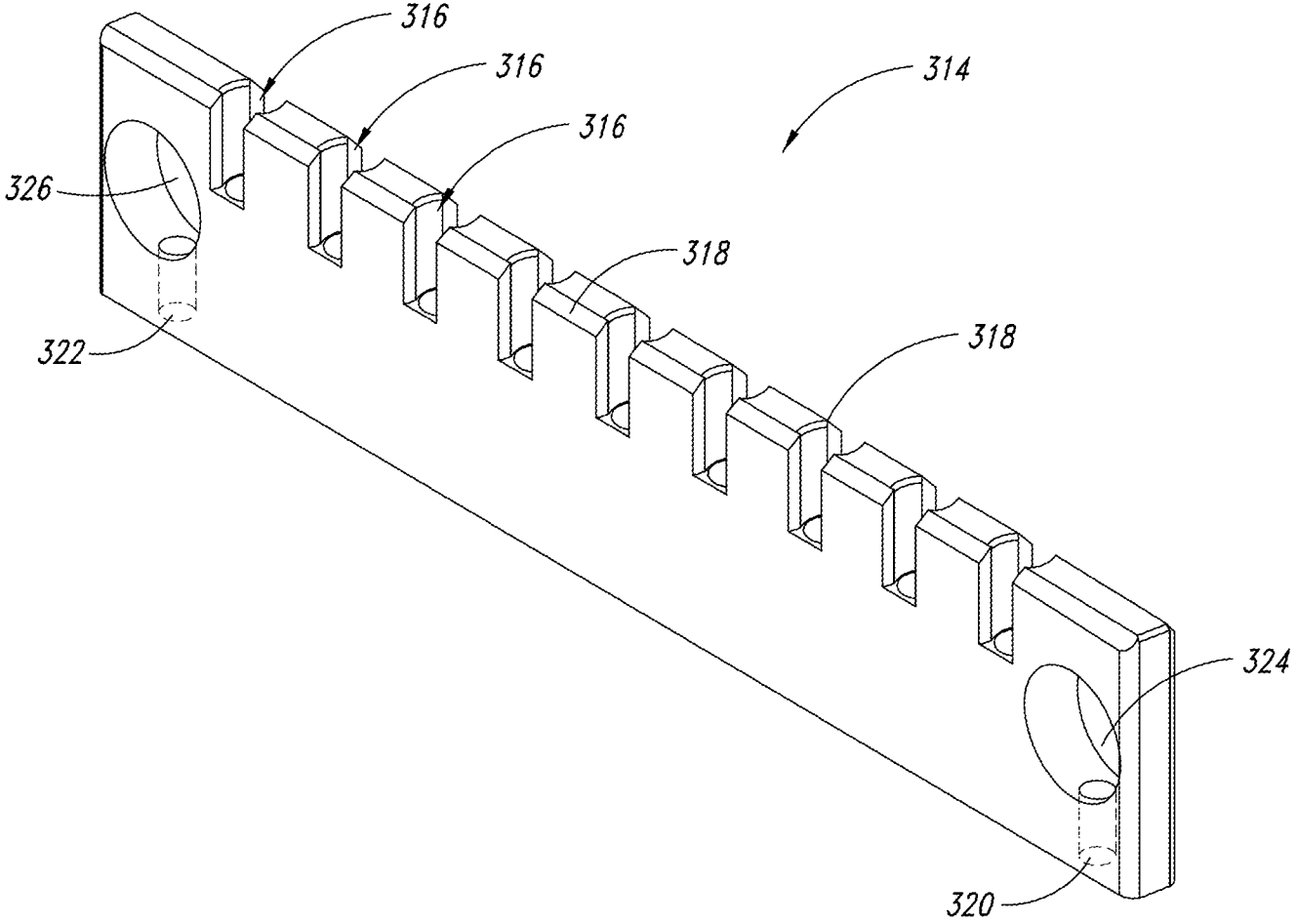
FIG. 19 is a perspective view of a carriage, according to at least one illustrated embodiment.

As seen in FIG. 6, each of the carriages 144 includes first and second apertures 162*a*, 162*b* extending through the width of the carriage 144, third and fourth apertures 164*a*, 164*b* extending through the height of the carriage 144 from its top surface to the first and second apertures 162*a*, 162*b*, respectively, and a plurality of set screws received within the third and fourth apertures 164*a*, 164*b*. FIG. 19 illustrates a perspective view of another implementation of a carriage 314, which can have the same structure and features as the carriages 144 except as described herein. For example, the carriage 314 can include a plurality of (e.g., nine) amp tube wells 316 extending partially down into the carriage 314 from its top surface. Each of the amp tube wells 316 can be sized and otherwise configured to receive and hold respective amp tubes, such as amp tubes that have relatively small diameters at their bottom ends and relatively large diameters at their top ends. For example, each of the amp tube wells 316 can have bottom ends that are completely contained within the width of the carriage 314 and top ends that extend to and are open at opposing side surfaces of the carriage 314, so that an open horizontal passage is formed through the top of and along the width or the carriage 314 at each of the amp tube wells 316, and so that the top ends of the amp tube wells 316 form slots that extend downward into the carriage 314 from the top surface of the carriage 314.

Further, the carriage 314 can have two chamfered corners 318 that extend along the length of the carriage 314 where the top surface of the carriage 314 meets the two side surfaces of the carriage 314. The chamfered corners 318 can facilitate streamlined passage of the blades 192 or 310 adjacent to the carriage 314 and along the length of the carriage 314. Further still, the carriage 314 can also have first and second vertical apertures 320, 322 at opposing ends thereof along its length, which extend through the height of the carriage 314 from its bottom surface to first and second rotor-bearing apertures 324, 326, respectively. The first and second vertical apertures 320, 322 can have threads corresponding to an M3 tap, and can be configured to receive one or more set screws. Because the apertures 320, 322 extend through the bottom of the carriage 314, and the apertures 164*a* and 164*b* extend through the top of the carriages 144, the apertures 320, 322 are hidden and better-protected from contamination than the apertures 164*a*, 164*b*.

Figure 20:
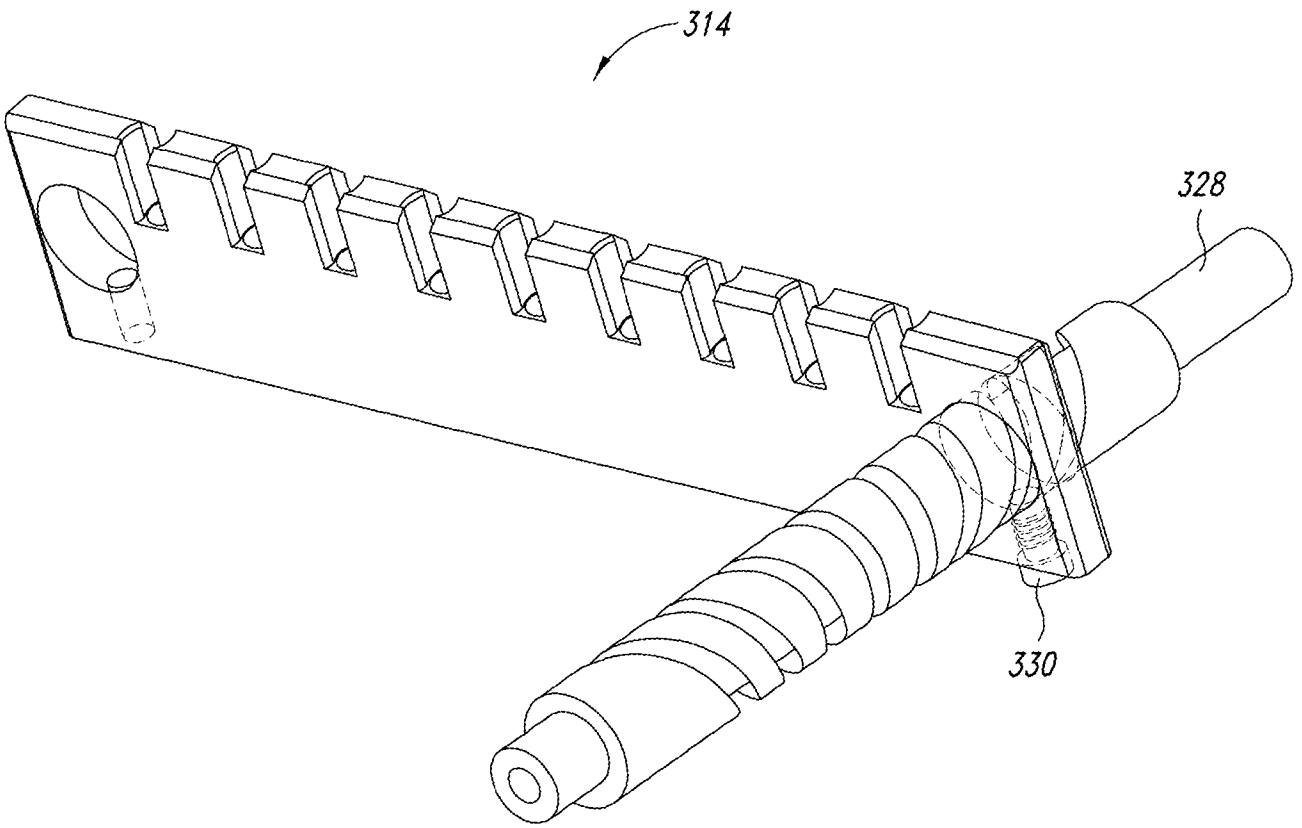
FIG. 20 is a perspective view of the carriage of FIG. 19 with a rotor and a set screw coupled thereto, according to at least one illustrated embodiment.
Figure 21:
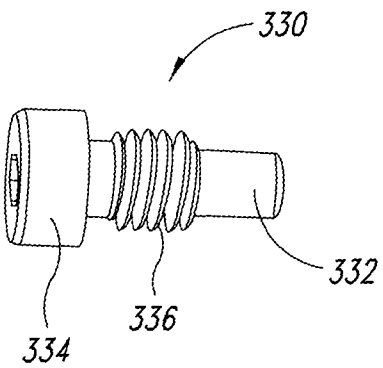
FIG. 21 illustrates the set screw of FIG. 20 at a larger scale, according to at least one illustrated embodiment.

FIG. 20 illustrates the carriage 314 with a rotor 328 extending through the rotor-bearing aperture 324, and with a set screw 330 extending through the vertical aperture 320. The set screw 330 is threaded through the threads within the vertical aperture 320 such that an end portion of the set screw 330, which can be a dog point, is positioned within the rotor bearing aperture 324 and is positioned within a helical groove in the outer surface of the rotor 328, as described above for the dog-point set screws 168 and the grooves 166. FIG. 21 illustrates a larger view of the set screw 330. As seen in FIG. 21, the set screw 330 can include a dog point tip or end 332, which can be referred to as a pin 332, a head portion 334, which can have a hex-head socket, and a threaded portion 336 extending between the pin 332 and the head portion 334. Using the single set screw 330 rather than both the dog-point set screws 168 and the upper set screws 170 can simplify the system and its operation.

Those of skill in the art will recognize that many of the methods or algorithms set out herein may employ additional acts, may omit some acts, and/or may execute acts in a different order than specified.

U.S. provisional patent application Nos. 62/378,094, filed Aug. 22, 2016, and 62/419,198, filed Nov. 8, 2016, are hereby incorporated herein by reference, in their entireties. The various embodiments described above can be combined to provide further embodiments. Aspects of the embodiments can be modified, if necessary, to employ systems, circuits and concepts of various other patents, applications, or publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A variable spacing rack comprising:
- a frame, the frame having a first axis and a second axis, the second axis perpendicular to the first axis;
- a first carriage, the first carriage elongated and having a length and a first plurality of wells arrayed along the length of the first carriage, the first carriage positioned parallel to the first axis of the frame and mounted to translate along the second axis of the frame;
- at least a second carriage, the second carriage elongated and having a length and a second plurality of wells arrayed along the length of the second carriage, the second carriage positioned parallel to the first axis of the frame and mounted to translate along the second axis of the frame;
- a first rotor, the first rotor rotatably mounted to the frame parallel with the second axis of the frame, the first rotor having an outer surface, a first right-handed helical groove in the outer surface of the first rotor, and a first left-handed helical groove in the outer surface of the first rotor;
- a first pin physically coupled to the first carriage and positioned to ride in the first right-handed helical groove of the first rotor; and
- at least a second pin physically coupled to the second carriage and positioned to ride in the first left-handed helical groove of the first rotor.

2. The variable spacing rack according to claim 1, further comprising:
- a first plurality of additional carriages, in addition to the first and the second carriages, each of the first plurality of additional carriages elongated and having a respective length and a respective plurality of wells arrayed along the length of the respective additional carriage, the first plurality of additional carriages each positioned parallel to the first axis of the frame and mounted to translate along the second axis of the frame;
- a plurality of additional right-handed helical grooves, in addition to the first right-handed helical groove, in the outer surface of the first rotor; and
- a first plurality of additional pins, in addition to the first and the second pins, each of the additional pins of the first plurality of additional pins physically coupled to a respective one of the additional carriages of the first plurality of additional carriages and positioned to ride in a respective one of the additional right-handed helical grooves.

3. The variable spacing rack according to claim 2, further comprising:
- a second plurality of additional carriages, in addition to the first, the second, and the first plurality of additional carriages, each of the second plurality of additional carriages elongated and having a respective length and a respective plurality of wells arrayed along the length of the respective additional carriage, the second plurality of additional carriages each positioned parallel to the first axis of the frame and mounted to translate along the second axis of the frame;
- a plurality of additional left-handed helical grooves, in addition to the first left-handed helical groove, in the outer surface of the first rotor; and a second plurality of additional pins, in addition to the first, the second, and the first plurality of additional pins, each of the additional pins of the second plurality of additional pins physically coupled to a respective one of the additional carriages of the second plurality of additional carriages and positioned to ride in a respective one of the additional left-handed helical grooves.

4. The variable spacing rack according to claim 3 wherein the first carriage and the first plurality of additional carriages includes a total of four carriages and the second carriage and the second plurality of additional carriages includes a total of four carriages.

5. The variable spacing rack according to claim 4 wherein the wells of the first carriage, the second carriage, and the additional carriages of the first and the second pluralities of additional carriages are each sized and dimensioned to at least partially receive a respective one 0.1 ml amplification tube.

6. The variable spacing rack according to claim 5 wherein the first carriage, the second carriage, and the additional carriages of the first and the second pluralities of additional carriages each includes nine wells.

7. The variable spacing rack according to claim 5 wherein the wells of the first carriage, the second carriage, and the additional carriages of the first and the second pluralities of additional carriages are spaced apart from one another along the respective lengths of the carriages by about 9.0 mm.

8. The variable spacing rack according to claim 3 wherein the first right-handed helical groove has a first pitch and the first left-handed helical groove has a second pitch, a magnitude of the second pitch equal to a magnitude of the first pitch, a handedness of the first right-handed helical groove opposite to a handedness of the first left-handed helical groove.

9. The variable spacing rack according to claim 1, further comprising:

a second rotor, the second rotor rotatably mounted to the frame parallel with the second axis of the frame, the second rotor having an outer surface, a right-handed helical groove in the outer surface of the second rotor, and a left-handed helical groove in the outer surface of the second rotor;

a third pin physically coupled to the first carriage and positioned to ride in the first helical groove of the second rotor; and at least a fourth pin physically coupled to the second carriage and positioned to ride in the second helical groove of the second rotor.

10. The variable spacing rack according to claim 9 wherein the first carriage includes a first and a second aperture that each extend completely through the first carriage transversely with respect to the length of the first carriage, and which respectively receive the first and the second rotors therethrough, and the second carriage includes a third and a fourth aperture that each extend completely through the second carriage transversely with respect to the length of the second carriage, and which respectively receive the first and the second rotors therethrough.

11. A variable spacing rack comprising:

a rotor having an outer surface, a first helical groove in the outer surface, and a second helical groove in the outer surface;

a first carriage having:

a first aperture that extends completely through the first carriage along a first axis;

a first pin that extends from the first carriage into the first aperture; and a first well that extends into the first carriage along a second axis that is transverse to the first axis; and a second carriage having:

a second aperture that extends completely through the second carriage along the first axis;

a second pin that extends from the second carriage into the second aperture; and a second well that extends into the second carriage along a third axis that is parallel to the second axis;

wherein the rotor extends through the first aperture and through the second aperture, the first pin is seated within the first helical groove, and the second pin is seated within the second helical groove.

12. The variable spacing rack according to claim 11 wherein the rotor has a central longitudinal axis that is coincident with the first axis and rotation of the rotor about the first axis actuates the first and the second carriages to translate along the first axis with respect to the rotor.

13. The variable spacing rack according to claim 12 wherein the first helical groove has a first helical pitch, the second helical groove has a second helical pitch that is not the same as the first helical pitch, and rotation of the rotor about the first axis actuates the first and the second carriages to translate along the first axis with respect to each other.

14. The variable spacing rack according to claim 13 wherein one full rotation of the rotor about the first axis actuates the first and the second carriages to translate along the first axis by 4.5 mm with respect to each other.

15. The variable spacing rack according to claim 11 wherein the second axis is perpendicular to the first axis.

16. The variable spacing rack according to claim 11 wherein the first pin is an end portion of a set screw that extends from the first carriage into the first aperture along an axis parallel to the second axis.

17. The variable spacing rack according to claim 11, further comprising:

a second rotor having a second outer surface, a third helical groove in the second outer surface, and a fourth helical groove in the second outer surface;

wherein the first carriage further includes:

a third aperture that extends completely through the first carriage along a fourth axis that is parallel to the first axis; and a third pin that extends from the first carriage into the third aperture;

wherein the second carriage further includes:

a fourth aperture that extends completely through the second carriage along the fourth axis; and a fourth pin that extends from the second carriage into the fourth aperture; and wherein the second rotor extends through the third aperture and through the fourth aperture, the third pin is seated within the third helical groove, and the fourth pin is seated within the fourth helical groove.

18. The variable spacing rack according to claim 17 wherein the first axis is parallel to the fourth axis.

19. The variable spacing rack according to claim 17 wherein the first carriage extends from the first rotor to the second rotor along a fifth axis that is perpendicular to the first, the second, the third, and the fourth axes, and the second carriage extends from the first rotor to the second rotor along a sixth axis that is parallel to the fifth axis.

20. The variable spacing rack according to claim 11, further comprising:

a first PCR amp tube positioned within the first well; and a second PCR amp tube positioned within the second well.

21. The variable spacing rack according to claim 20 wherein the first PCR amp tube is coupled to the second PCR amp tube, a blade assembly is mounted to the rack, and the blade assembly includes a blade configured to separate the first PCR amp tube from the second PCR amp tube.

22. The variable spacing rack according to claim 21, further comprising:

a first rail that extends transverse to the first, the second, and the third axes; and a second rail that extends parallel to the first rail;

wherein the blade assembly is mounted to the first and second rails to slide along the first and second rails.

23. The variable spacing rack according to claim 11, further comprising a cover positioned above the first and the second wells.

24. The variable spacing rack according to claim 23 wherein the cover includes a first hole positioned above the first well and a second hole positioned above the second well.

25. A method of operating a variable spacing rack, comprising:

positioning a set of PCR amp tubes that are coupled to one another into a set of amp tube wells of a plurality of carriages of the variable spacing rack, the plurality of carriages spaced apart from one another by a first distance;

translating a blade assembly across the variable spacing rack to separate the PCR amp tubes from one another;

turning a rotor engaged with the plurality of carriages, thereby translating the plurality of carriages with respect to one another so that the plurality of carriages are spaced apart from one another by a second distance that is not the same as the first distance; and using a multi-channel pipette to transfer a plurality of samples into the set of PCR amp tubes.

26. The method according to claim 25 wherein the set of PCR amp tubes is a set of four 0.1 ml amp tubes, the set of amp tube wells is a set of four amp tube wells, and the plurality of carriages is four carriages.

27. The method according to claim 25 wherein the first distance is 4.5 mm center to center and the second distance is 9.0 mm center to center.

28. The method according to claim 25 wherein the rotor includes a plurality of helical grooves and each carriage of the plurality of carriages includes a pin engaged with a respective one of the plurality of helical grooves.

29. The method according to claim 25, further comprising:

before using the multi-channel pipette to transfer the plurality of samples into the set of PCR amp tubes, positioning a cover over the PCR amp tubes.

30. The method according to claim 29 wherein the cover includes a plurality of holes and positioning the cover includes positioning the holes directly over the PCR amp tubes.

* * * * *